US005676624A

United States Patent [19]

Watterson et al.

[11] Patent Number: 5,676,624

[45] Date of Patent: Oct. 14, 1997

[54] PORTABLE REORIENTING TREADMILL

[75] Inventors: Scott R. Watterson; William T. Dalebout, both of Logan; Rodney L. Hammer, Lewiston, all of Utah

[73] Assignee: ICON Health & Fitness, Inc., Logan, Utah

[21] Appl. No.: 594,271

[22] Filed: Jan. 30, 1996

[51] Int. Cl.[6] ..... A63B 22/02

[52] U.S. Cl. ..... 482/54

[58] Field of Search ..... 482/54

[56] References Cited

U.S. PATENT DOCUMENTS

| | | |
|---|---|---|
| D. 207,541 | 5/1967 | Hesen . |
| D. 211,801 | 7/1968 | Quinton . |
| 321,388 | 6/1885 | Ruebsam . |
| 663,486 | 12/1900 | Boren . |
| 881,521 | 3/1908 | Wilson . |
| 1,020,777 | 3/1912 | Peterson . |
| 1,715,870 | 6/1929 | Spain . |
| 1,850,530 | 3/1932 | Brown . |
| 1,902,694 | 3/1933 | Edwards . |
| 1,928,089 | 9/1933 | Blickman . |
| 1,973,945 | 9/1934 | Chavin et al. . |
| 2,855,200 | 10/1958 | Blickman . |
| 3,127,171 | 3/1964 | Noland et al. . |
| 3,378,259 | 4/1968 | Kupchinski . |
| 3,586,322 | 6/1971 | Kverneland . |
| 3,589,715 | 6/1971 | Mark et al. . |
| 3,614,097 | 10/1971 | Blickman . |
| 3,642,279 | 2/1972 | Cutter . |
| 3,659,845 | 5/1972 | Quinton . |
| 3,731,917 | 5/1973 | Townsend . |
| 3,741,538 | 6/1973 | Lewis et al. . |
| 3,874,657 | 4/1975 | Niebojewski . |
| 3,918,710 | 11/1975 | Niebojewski . |
| 4,026,545 | 5/1977 | Schonenberger . |
| 4,066,257 | 1/1978 | Moller . |
| 4,248,476 | 2/1981 | Phelps . |
| 4,300,761 | 11/1981 | Howard . |
| 4,422,635 | 12/1983 | Herod et al. . |
| 4,625,962 | 12/1986 | Street . |
| 4,664,646 | 5/1987 | Rorabaugh . |
| 4,679,787 | 7/1987 | Guilbault . |
| 4,757,987 | 7/1988 | Allemand . |
| 4,805,901 | 2/1989 | Kulick . |
| 4,826,153 | 5/1989 | Schalip . |

(List continued on next page.)

FOREIGN PATENT DOCUMENTS

| | | |
|---|---|---|
| 83466 | 8/1908 | Germany . |
| 56-150562 | 4/1980 | Japan . |
| 56-56358 | 5/1981 | Japan . |
| 1169148 | 10/1969 | United Kingdom . |
| 1 326 263 | 8/1973 | United Kingdom . |
| 2 120 560 | 12/1983 | United Kingdom . |

OTHER PUBLICATIONS

Copy of brochure entitled "Technology for Total Fitness Genesis 3000", 7 pages—copyright 1985.

Cover and selected pages from the Taiwan Buyer's Guide—1993.

Cover page, pp. 2 and 81 of brochure entitled "Taiwan Sports Goods" (Buyers' Guide '95).

Copy of brochure entitled "Technology for Total Fitness Genesis 1000", 6 pages—copyright 1985.

Copy of brochure entitled "Technology for Total Fitness Genesis 2000", 6 pages—copyright 1985.

*Primary Examiner*—Lynne A. Reichard

*Attorney, Agent, or Firm*—Trask, Britt & Rossa

[57] ABSTRACT

The treadmill has a tread base that is rotatably attached to and between a left upright and a right upright. The tread base is rotatable between a first position for performing exercises and an upright or storage position. A latching structure is provided to latch the tread base to the support structure. The treadmill also includes inclination structure for inclining the tread relative to the support surface when in the first position. The treadmill also includes rigid handles and in one configuration movable handles. The tread base also has a rigid undersurface or pan to fully enclose the underside of the tread base. A lift assist gas cylinder is also interconnected between the tread base and the feet attached to the uprights.

13 Claims, 15 Drawing Sheets

U.S. PATENT DOCUMENTS 4,905,330 3/1990 Jacobs .
4,913,396 4/1990 Dalebout et al. .
4,913,423 4/1990 Farran et al. .
4,921,247 5/1990 Sterling .
4,974,831 12/1990 Dunham .
4,998,725 3/1991 Watterson et al. .
5,002,271 3/1991 Gonzales .
5,029,801 7/1991 Dalebout et al. .
5,058,881 10/1991 Measom .
5,102,380 4/1992 Jacobson et al. .
5,109,778 5/1992 Berkowitz et al. .
5,110,117 5/1992 Fisher et al. .
5,184,988 2/1993 Dunham .
5,192,255 3/1993 Dalebout et al. .
5,207,622 5/1993 Wilkinson et al. .
5,207,628 5/1993 Graham .
5,282,776 2/1994 Dalebout .
5,299,992 4/1994 Wilkinson .
5,352,167 10/1994 Ulicny .
5,372,559 12/1994 Dalebout et al. .
5,441,467 8/1995 Stevens .

PORTABLE REORIENTING TREADMILL

BACKGROUND OF THE INVENTION

1. Field of the Invention

This invention relates to treadmills and more specifically to treadmills which have a base reorientable from a first position in which the user performs exercises and a second position or storage position in which the base may be further reoriented for transport about a support surface.

2. State of the Art

Typical treadmills include a continuous or endless belt trained about a pair of laterally extending rollers mounted to and between spaced apart longitudinally extending rigid treadmill frame members. A deck is secured to and between the frame members or mils; and the endless belt moves over and under the deck upon rotation about the laterally extending rollers positioned at opposite ends of the deck.

Non-motorized treadmills typically have a flywheel to store energy from the user moving the tread. The flywheel delivers the energy to the front roller to maintain even rotation or operation of the tread particularly when the user is moving on the treadmill in such a fashion that the user's feet simultaneously leave the treadmill or substantially leave the treadmill, such as when jogging or running.

In a typical motorized treadmill, an electric motor is provided to supply rotational torque to the front roller to, in turn, drive the endless belt. The motor is typically operated through controls positioned on a control console operable by a user positioned on the endless belt.

Many treadmills have an upright post or column with a control console positioned at the front end of the treadmill to contain controls or present information desirable or useful to the user. For example, time, speed, pulse, calorie-burn and other similar information may be presented in one or more different combinations. Controls for speed, inclination, exercise program or the like, may also be part of the control console. In other circumstances, a tape player, disc player or similar device may be mounted or attached to the upright post for operation by the user during the exercise period.

The deck with the endless belt trained thereabout is typically oriented generally in alignment with a support surface such as the floor or ground in an area where exercise is being performed. In turn, a treadmill may be said to occupy or use floor space that may be at a premium in given locations. For example, in an apartment or in a small room used for exercise, the available floor space may be needed for multiple uses. In such circumstances, treadmills may be reoriented or repositioned for storage. U.S. Pat. No. 4,066,257 (Moller) shows a treadmill that is secured to a wall. It may be reoriented to an upright position against the wall for storage. U.S. Pat. No. 4,757,987 (Allemand) shows a treadmill that may be folded into a portable compact structure.

U.S. Pat. No. 4,679,787 (Guilbault) shows a structure that may be used as a rowing machine or a treadmill in combination with a bed. That is, the exercise structure is combined with the bed and stored underneath the bed.

U.S. Pat. No. 3,642,279 (Cutter) shows a treadmill that may be reoriented to an upright position for storage and moved about upon wheels positioned at one end of the treadmill. Similarly, the HEALTH WALKER treadmill made by Battle Creek Equipment Company, Battle Creek, Mich., shows a manual treadmill which may be repositioned to an upright orientation for storage. Similarly, U.S. Pat. No. Des. 207,541 (Hesen) shows an exercise treadmill configured for reorientation from an operational configuration to an upright orientation for storage configuration.

U.S. Pat. No. Des. 316,124 (Dalebout, et al.) and U.S. Pat. No. 4,913,396 (Dalebout, et al.) show treadmill structures that are not specifically intended for reorientation of the treadmill deck or endless belt when not in use. However, some treadmills have upright structures that may be reconfigured by placing the forward upright structure or post in an orientation generally in alignment with the treadmill deck as seen in U.S. Pat. No. 5,102,380 (Jacobson, et al.).

SUMMARY OF THE INVENTION

The treadmill has a support structure with feet means for stably positioning the support structure on a support surface to be free standing. The support structure has upright structure extending upwardly from the feet means.

A tread base has a frame that includes a front, rear, left side and right side. An endless belt is positioned between the left side and the right side. The frame is connected to the support structure to be movable between a first position in which the endless belt is positioned for operation by a user positioned thereon, and a second position in which the rear of the frame is positioned toward the support structure.

The treadmill includes roller means adapted to the feet means for engagement with the support surface when the support structure it is reoriented to a moving position for movement of said treadmill on and about said support surface by the user. The treadmill also includes handle means associated with the support structure for moving the support structure from a stable position on a support surface to a moving position rotatably displaced therefrom.

Desirably, the feet means include a left foot positioned proximate the left side and the right foot positioned proximate the right side. The left foot and the right foot each have a forward end spaced outwardly from their respective left upright member and right upright members.

The roller means preferably includes wheels rotatably attached to said forward end of said left foot and said right foot for contact with the support surface when in the moving position. The upright structure desirably includes a left upright member and a right upright member spaced from and in general alignment with the left upright member. The handle means includes a left handle mechanically associated with the left upright member and a right handle mechanically associated with a right upright member.

The treadmill is configured to have a center of gravity positioned at a height spaced upwardly above the center of rotation of the tread base. The height in which the handles are positioned above the center of gravity is selected to provide leverage for the user of the treadmill to move the treadmill about the support surface with the support structure in the moving position and the tread base in the storage on second position.

The support structure desirably includes a cross member extending to and between the left foot and the right foot proximate to their respective forward ends. The tread base has a front portion extending from about a position midway between the front and the rear to said front. The tread base is rotatably attached to the support structure. More particularly, the front portion of the tread base is rotatably attached to the support structure.

BRIEF DESCRIPTION OF THE DRAWINGS

In the drawings which illustrate what is presently regarded to be the best mode for carrying out the invention.

DETAILED DESCRIPTION OF THE ILLUSTRATED EMBODIMENT

Figure 1:
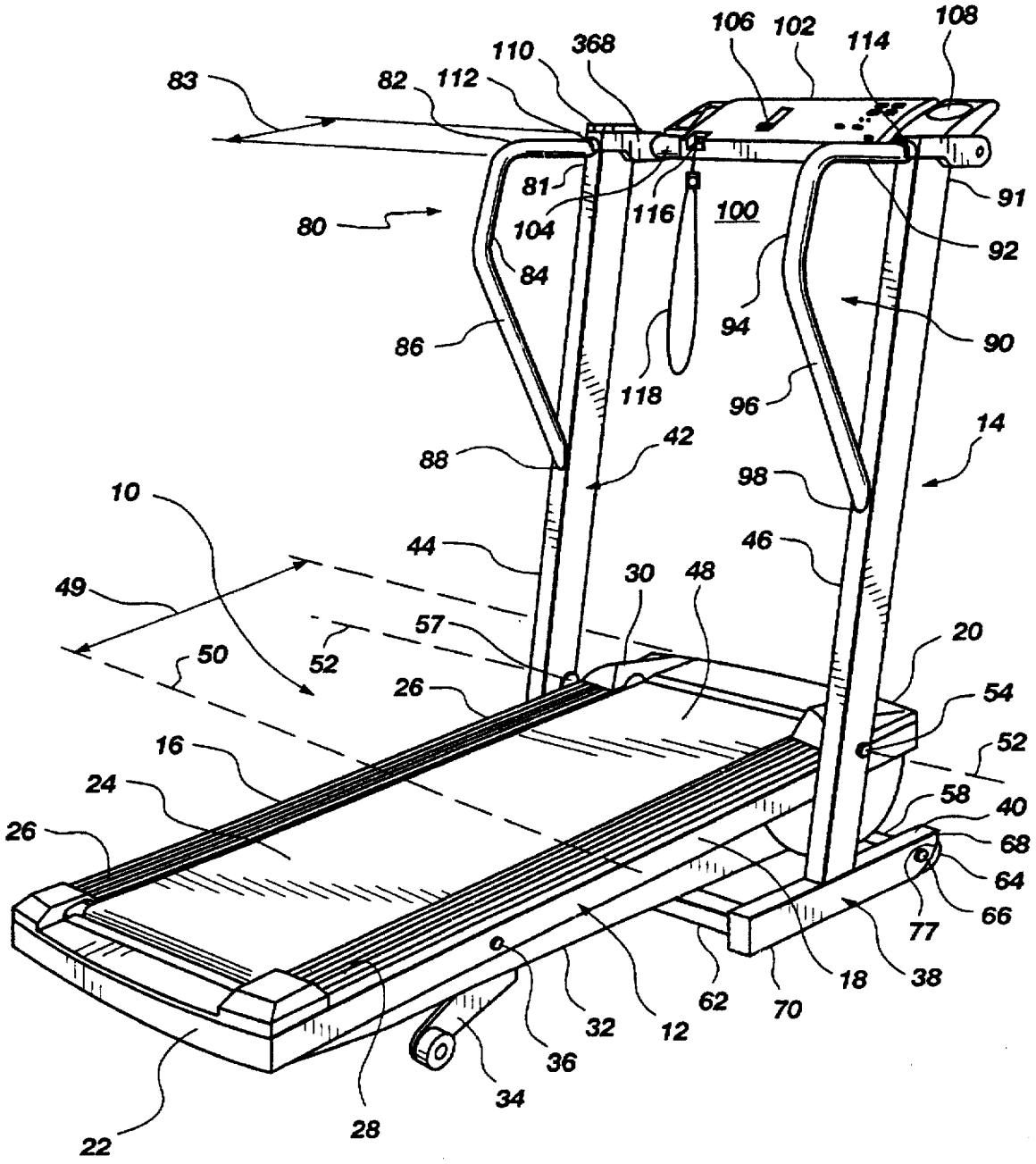
FIG. 1 is a perspective illustration of a reorienting treadmill of the present invention with the tread base positioned in a first position for a user to perform exercises.

A reorienting treadmill 10 is shown in FIG. 1 to have a tread base 12 which is movably connected to support structure 14. The tread base 12 has a left side 16 and a right side 18. As can be seen, the left side 16 and the right side 18 are spaced apart and in general alignment. The tread base also has a front end member 20 and a rear end member 22. As here shown, the front end member 20 and the rear end member 22 are each cross members that form part of the overall frame of the tread base 12. That is, the frame may be said to include the front end member 20, the rear end member 22, the left side 16 and the right side 18. The frame may also include other structural members.

It should be noted that the front end member 20 and the rear end member 22 denote specific structural members. However, in some contexts the front end and rear end may refer to the region or area proximate the front or the rear of the tread base 12.

The tread base 12 has an endless belt 24 positioned between the left side 16 and the right side 18. The endless belt 24 or tread is configured to receive a user thereon to perform exercises such as running, walking, jogging or the like. The user also may perform stationary exercises such as bending, stretching or the like while positioned on the endless belt 24. However, the machine principally is intended for use in performing walking, running or jogging exercise.

The tread base 12', as here shown in FIG. 1, has a left side rail 26 positioned over the top of the left side and a right side rail 28 positioned over the top of the right side 18. The left side rail 26 and the right side rail 28 are configured and positioned to support a user. That is, a user seeking to dismount from the moving endless belt 24 or tread may simply place the user's left foot on the left rail 26 and the user's right foot on the right rail 28 to dismount or leave the moving surface to terminate the exercise before terminating movement of the endless belt 24.

It can also be seen that the tread base 12 has a front cover 30 positioned over structure such as pulley 144 associated with the drive mechanism for driving the front roller 252 not illustrated in FIG. 1, but illustrated and discussed more fully hereinafter with respect to FIG. 4. The front cover 30 is also provided for aesthetics and for safety to minimize the risk of materials entering into the area thereunder and interfering with operation of the drive mechanism or otherwise becoming entangled therewith.

The tread base 12 of FIG. 1, also includes an underside rigid surface 32 or part secured to the left side 16, the right side 18, the from end member 20 and the rear end member 22 as more fully discussed hereinafter.

The tread base 12 also has rear feet means for positioning and supporting the tread base on the support surface. The rear feet means include specifically a left foot 160 (FIG. 4) and a right foot 34 which is rotatably secured to the right side to rotate about a pin 36. That is, the right foot 34 and the left foot 160 rotate about pin 36 and pin 161 (FIG. 4) to move toward and away from the endless belt 24 to, in turn, vary the inclination of the tread base 12 relative to the support surface.

Figure 2:
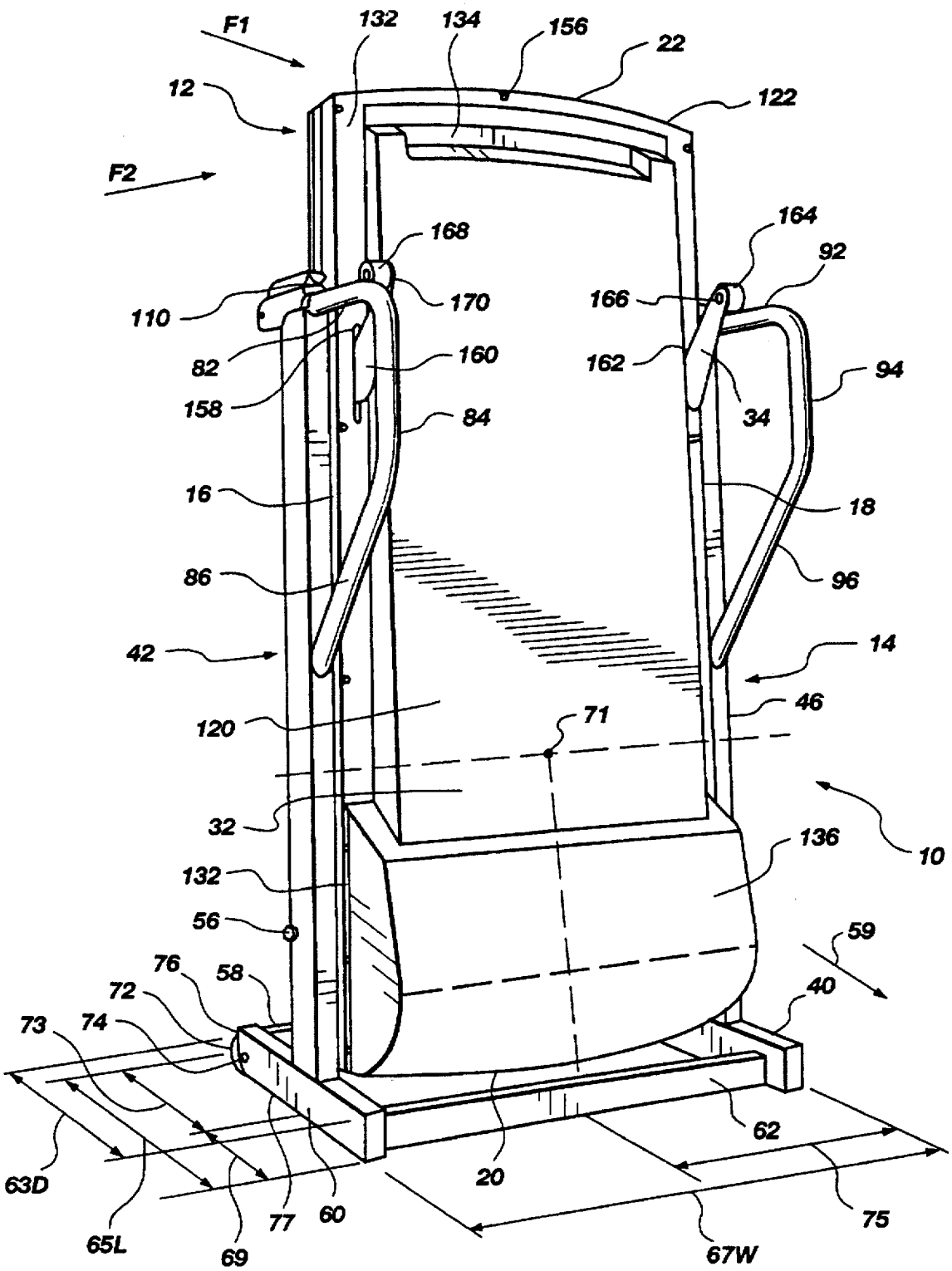
FIG. 2 is a perspective illustration of a reorienting treadmill of FIG. 1 with the tread base reoriented to a second or storage position.

The support structure 14 of the reorienting treadmill 10 of FIG. 1 has feet means 38. The support structure 14 as shown is configured to be free-standing and to stably support the treadmill and more specifically the tread base 12 in the first orientation of the tread base 12 as shown in FIG. 1 and in the second or storage orientation of the tread base as shown in FIG. 2.

The feet means 38 includes a left foot 60 (FIG. 2) and a right foot 40. The support structure 14 also includes an upright structure 42 to extend upwardly from the feet means 38. More specifically, the upright structure includes a left upright member 44 and a right upright member 46 spaced from the left upright member and in general alignment therewith.

The tread base 12 has a front portion 48 that extends 49 from the front end member 20 to a position or point 50 about midway between the front end member 20 and the rear end member 22. It may be noted that the midway point 50 is here shown to be at a distance halfway between the front end member 20 and the rear end member 22. However, those skilled in the art will recognize that the actual midpoint or midway position 50 need only be approximate and is here defined to indicate that the front portion 48 is essentially that half of the tread base 12 which may be said to be frontward or forward of a similar half portion which may be said to be rearward.

The front portion 48 of the tread base 12 is rotatably attached to the support structure 14 to rotate around a base axis 52. As shown in FIGS. 1 and 4, the tread base 12 rotates with or around bolts or pins 54 and 56 which function as an axle and are connected to the right upright 46 and the left upright 44. The pins 54 and 56 connect to pivoting straps 55 and 57 which are attached to their respective right and left sides 18 and 16 to extend upwardly therefrom. With the straps 55 and 57 extending upwardly, the base axis 52 may be located above the tread base 12 when the tread base is in the first position as shown in FIG. 1. The length or height of the straps 55 and 57 and the orientation to extend upwardly from the sides 16 and 18 or downwardly from the sides 16 and 18 may be selected to position the center of gravity of the tread base 12 relative to the base axis 52. That is, the necessary force or leverage to lift and move the tread base 12 from the first position to the second position may be varied by varying the distance between the center of gravity and the base axis 52 as discussed more fully hereinafter.

In FIG. 1 the support structure 14 and more particularly the feet means 38 is shown to include a forward cross member 58 which is connected to the right foot 40 to extend to the left foot 60. Similarly, the feet means 38 includes a rear cross support 62 that extends between and is connected by nuts and bolts 61 and 63 to brackets 65 and 67 to the right foot 40 and the left foot 60 spaced rearward 59 from the front cross member 58 a distance 63D selected to rigidly support the right foot 40 and left foot 60. The cross members 58 and 62 also may be connected by welding, brazing or the like as desired.

The right foot 40 and left foot 60 are each sized in length and spaced apart a distance 67W to provide the support structure 14 with a footprint so that the support structure is freestanding and also stably supports the tread base 12 in the first position, in the second position and in movement thereinbetween. The footprint may be regarded as the perimeter of the geometric figure projected on the support surface that is defined by left foot 60 and right foot 40. The footprint could be in any desired geometric shape to have a length 65L and width 67W. The length 65L and width 67W are selected so that the distance 69 between the vertical location of the center of gravity 71 (projected onto the support surface) of entire treadmill 10 is selected so that the force necessary to tip the treadmill 10 is necessarily more or higher than that applied by a nudge or accidental bump. That is, a rearward 59 force $F_1$ applied at the rear end member 22 of the tread base 12 in the second position would tend to tip the treadmill 10 rearwardly. A force exerted forwardly would, of course, tend to tip the treadmill 10 forwardly. Thus, the feet 40 and 60 extend a similar distance 73 selected so that the tipping force $F_1$ necessary to cause rotation or tip of the treadmill exceeds a nominal sum (e.g., 1 pound) and indeed is at least a somewhat larger sum (e.g., 10 to 20 lbs.) and even more preferably a significantly larger sum. The distance 73 preferably is selected so that tipping can be effected only by a user deliberately seeking to rotate or tip the treadmill 10 in normal use.

Similarly, the distance 67W of the treadmill 10 is selected so that the distance 75 between the center of gravity 71 and the feet 40 and 60 will resist accidental tipping by a bump or nudge. That is, the treadmill 10 cannot be tipped over sideways except upon application of a force $F_2$ that exceeds a nominal sum (e.g., 1 pound) and is about the same as force $F_1$.

It may also be seen that the right foot 40 has a right wheel 64 rotatably positioned at its forward end 68 to rotate about an axle 66. At the forward end 68, the right foot 40 angles rearwardly 77 toward a lower edge 70 thereby exposing the wheel 64 to facilitate rotation of the support structure 14 onto the wheel 64 for movement of the treadmill 10 on the support surface.

Similarly, the left foot 60 (FIG. 2) has a left wheel 72 positioned to rotate about an axle 74. The left wheel 72 is exposed to facilitate rotation and movement inasmuch as the left foot 60 is formed to have a front portion 76 that angulates rearward and downward towards the lower edge 77 of the left foot 60. The left foot 60 and the right foot 40 are both made of a rectangular (incross section) hollow tube to contain the wheels 72 and 64. Therefore the support structure 14 can be tipped or rotated onto the left wheel 72 and right wheel 64.

It may also been seen in FIG. 1 that the support structure has associated therewith a pair of rigid non-movable handles. The left rigid non-movable handle 80 includes a first portion 82 that is connected to the left upright 44 near its upper or distal end 81. The first portion 82 extends rearwardly to a second portion 84 that extends downwardly towards the foot means 38. A third portion 86 is interconnected to the second portion to extend inwardly toward the upright 44 and is here preferably shown to be rigidly secured such as by welding 88 to the left upright 44.

The right rigid non-movable handle 90 is here shown to include a first portion 92 that is connected at the upper end 91 of the upright 46 to extend rearward from the right upright member 46. A second portion 94 is shown connected to the first portion 92 to extend downwardly toward the foot means 38. A third portion 96 extends from the second portion inwardly toward the right upright member 46 and is here shown to be secured such as by welding 98 to the right upright 46.

It can be seen that the pair of rigid non-movable handles 80, 90 define a space 100 therein between. That space 100 may be said to create a cage-like effect because the rigid handles 90 and 80 extend rearwardly (toward the rear end member 22) when the tread deck 12 is oriented in the first position shown in FIG. 1. The space 100 is here oriented over the forward part of the endless belt 24. The length 83 of the upper portions 82 and 92 of the handles 80 and 90 may be selected to increase or decrease the size of the space 100 and more particularly the volume. Thus, a user positioned at or proximate the mid point 50 on the endless belt 24 may perceive the handles 80 and 90 as near the user's hands for easy grasping to maintain balance when on the endless belt 24 and perceive the space 100 as a cage-like area toward which the user may move; and in turn the user may feel more stable or secure.

In FIG. 1, it can also be seen that the exercise treadmill 10 of the present invention has a control console 102 which is connected to a support bar 104 that is attached to and extends between the left upright 44 and the right upright 46. The console 102 has operating controls such as actuator 106 to operate the treadmill 10 and indication means which may be used by the operator to determine various parameters associated with the exercise being performed. The console 102 may also have a cup or glass holder 108 so that the user may position a liquid refreshment for use during the course of performing exercise.

The treadmill of FIG. 1 also includes a latching structure and more particularly a receiving mechanism 110, which is more fully discussed hereinafter.

It may also be seen in FIG. 1 that the left rigid non-movable handle 80 is fastened to the left upright 44 at its upper end 81 by a mechanical clamping structure 368 to be discussed more fully hereinafter. Similarly, the right rigid non-movable handle 90 is similarly attached by a clamping structure 114 and is more fully discussed hereinafter.

The control console 102 of FIG. 1 also has associated therewith a safety lock or key mechanism 116 with a loop structure 118 associated therewith for attachment about the waist or to the user. The safety lock or key structure 116 is configured so that if a user moves toward the rear end member 22 on the endless belt 24, a key (not shown) is removed from the control console thereby interrupting the electrical power to the motor driving the endless belt for a motorized treadmill.

Referring now to FIG. 2, the reorienting treadmill is shown with the tread base 12 reoriented relative to the support structure 14 to the second position in which the rear end member 22 of the tread base 12 is positioned towards the upright structure 42 of the support structure 14. In this configuration, it can be seen that the treadmill 10 is significantly more compact, occupying less floor space of the associated support surface.

Figure 4:
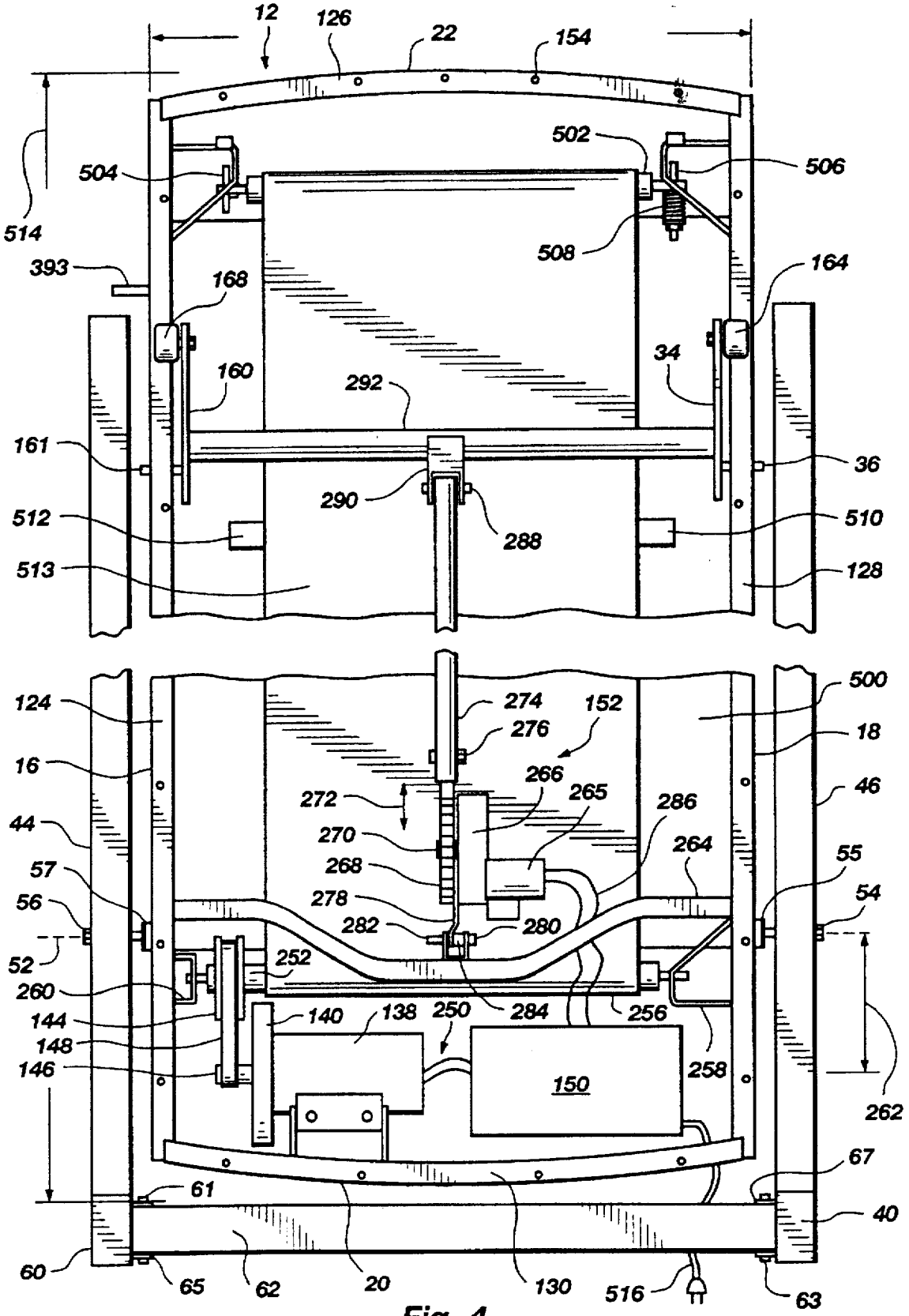
FIG. 4 is a partial view of portions of the reorienting treadmill of FIG. 1 and FIG. 2.

As can be better seen in FIG. 4, the tread base 12, the left side 16 and the right side 18 are here formed to present relatively flat mating surfaces. Similarly, the front end member 20 and rear end member 22 each present a flat surface to receive a portion of the perimeter 122 of the part or rigid surface 32. That is, the flat surface portion 124 of the left side, the flat surface portion 126 of the rear end member 22, the flat surface portion 128 of the right side 18 and the flat surface portion 130 of the front end member 20 are desirably formed to be in substantially the same plane to present a substantially flat surface to mate and register with the flat surface 132 formed along the perimeter 122 of the rigid surface 32.

The rigid surface 32 is here shown to be unitarily formed of a plastic-like material to present an essentially rigid underside 120. Although rigid, it may be made of material thin enough to be flexible or to deflect without breaking. The rigid surface 32 here has a recess 134 formed in it proximate the rear end 22 to provide a convenient hand position for the user to move or reorient the tread base 12 from the first position or exercise position shown in FIG. 1 to the second position or storage position shown in FIG. 2.

It may also be seen that rigid surface 32 has a housing portion 136 formed proximate the front end member 20 to cover operating structure such as the motor 138, the flywheel 140, and the driving belt 148. The housing 136 also covers the electrical motor controlling mechanism 150, as well as the mechanism necessary to operate the inclination structure as more fully discussed hereinafter.

In FIG. 2, the underside 120 of the tread base 12 is here shown with the part or rigid surface 32 in position. The tread base 12 without the part or rigid surface 32 leaves operating structure such as the motor 138, electrical components 150 and the inclination system 152 exposed (FIG. 4). Aside from an undesirable visual appearance, the exposed components can be hazardous providing sharp edges, points and structure against which items or things may bump or snag. Similarly, there is a risk of exposing electrical components to moisture, as well as exposing the user to an electrical shock hazard if the treadmill is inadvertently not turned off.

It may also be noted that the rigid surface 32 may be formed to cover only a portion of the exposed components or may be formed into multiple removable sections, if desired, to facilitate assembly or repair.

As better seen in FIG. 4, the flat surfaces 126, 128, 130 and 124 have a plurality of apertures 154 formed therein to receive screws 156 to secure the rigid surface 32 or part to form the underside of the tread base 12.

As better seen in FIG. 2, the rigid surface 32 has an aperture 158 formed therein for the left foot 160 to extend therethrough. A similar aperture 162 is formed to pass the right foot 34 therethrough. It may be noted that the right leg 34 has a wheel 164 appended proximate its distal end 166. Similarly, the left foot 160 has a wheel 168 appended proximate its distal end 170. The wheels 164 and 168 are rotatably attached to facilitate movement on a support surface when the tread base 12 is positioned in the first position. Other guides, skids or the like may be used to facilitate movement of both the feet 34 and 160 on the support surface.

Figure 3:
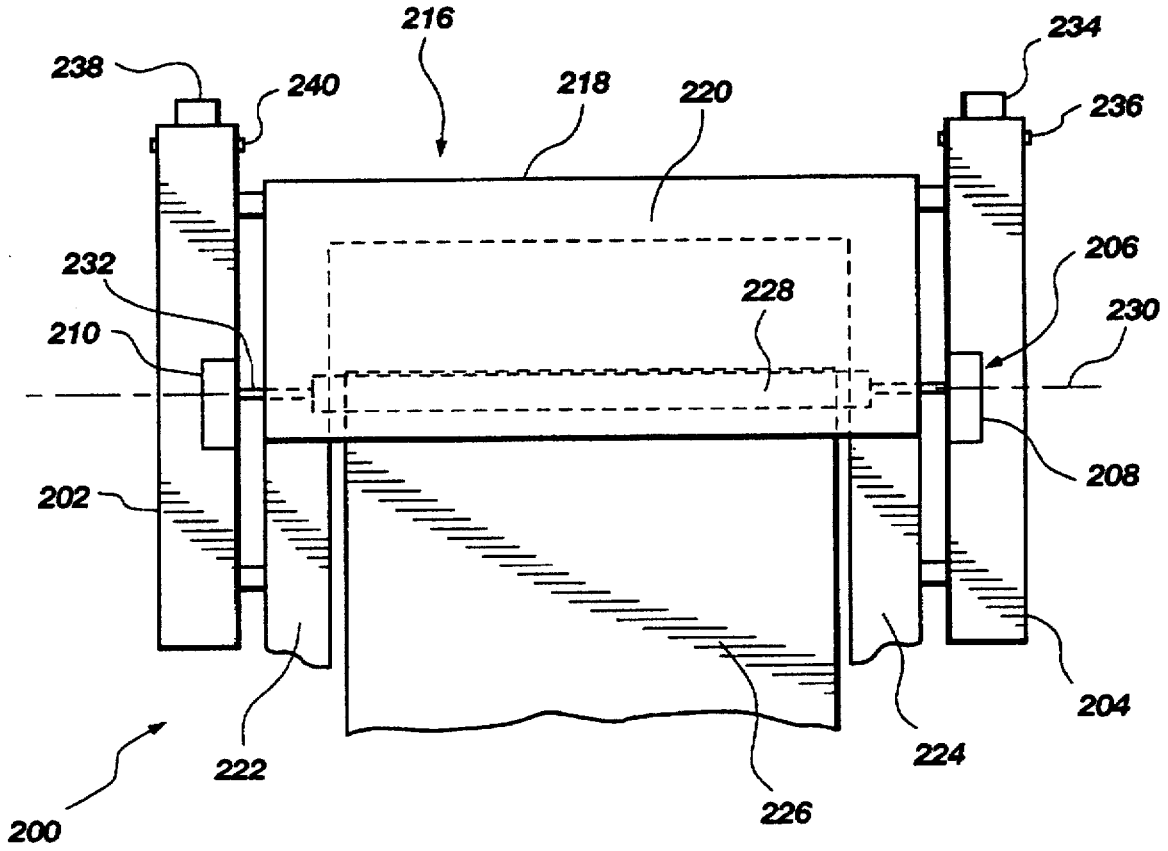
FIG. 3 is a partial, simplified plan view of a portion of an alternate configuration of a reorienting treadmill of the present invention.

Turning now to FIG. 3, an alternate configuration of a reorienting treadmill is shown, which is similar to the reorienting treadmill shown in FIGS. 1 and 2. As shown in FIG. 3, a reorienting treadmill 200 has a right foot 204 and a left foot 202. It also has a right upright 208 and a left upright 210 attached to and extending upward from the right foot 204 and a left foot 202. A tread base 216 has a front end 218 with a protective cap 220 positioned as shown. The tread base 216 has a left side 222 and a right side 224 with an endless belt 226 positioned between to receive a user comparable to the endless belt 24 in FIG. 1.

As here shown in FIG. 3, a front roller 228 is positioned to extend between the left side 222 and the right side 224. The front roller 228 has an axis 230 with an axle 232 extending therethrough to rotate about axis 230. The front roller 228 extends into the right upright 206 and the left upright 210 to function as a base axis similar to base axis 52. It may be also noted that the right foot 204 has a wheel 234 rotatably mounted by axle 236 within the right foot 204. Similarly, the left foot 202 has a left wheel 238 rotatably positioned within the left foot 202 by an axle 240.

As earlier noted, FIG. 4 shows a portion of the treadmill 10 of FIGS. 1 and 2. The treadmill 10 of FIGS. 1 and 2 is preferably a motor driven treadmill having a controller 150 interconnected by conductors 250 to motor 138. The motor rotates to operate a pulley 146, as well as a flywheel 140. The pulley 146 drives a belt 148 which, in turn, drives a pulley 144 connected to the front or drive pulley 252 about which the endless belt 256 is trained.

As can be seen in FIG. 4, the front roller or drive pulley 252 is connected to the right side 18 by a bushing 258. The pulley 252 is similarly connected to the left side 16 by a bushing 260.

As can be seen in FIG. 4, the motor 138 and the controller 150 are positioned between the front end member 20 and the rotation or base axis 52 to, in turn, position their mass or weight and control the location of the center of gravity. That is, the weight of the motor and the electrical components 150 create a cantilever effect because the mass thereof is displaced toward the front end member 20 a distance 262 to act as a counter balance upon rotation of the tread base 12 from the first position shown in FIG. 1 to the second position shown in FIG. 2, as well as here in FIG. 4.

As also seen in FIG. 4, a cross support 264 is interconnected such as by welding between the left side 16 and the right side 18 in order to receive the incline mechanism 152. That is, an incline mechanism 152 shown here in FIG. 4, as well as in the exploded view of FIG. 5, includes a motor 264 interconnected through a reduction gear mechanism 266 and pinion 270 to a rack 268. Operation of motor 265 causes the pinion 270 to drive the rack 268 forward and rearward 272 to, in turn, drive an extension 274. The rack 268 is connected to the extension 274 by a pin 276 or any other acceptable mechanical means.

The motor 265 and the reduction gear 266 are connected by a metal or rigid strap 278 to a bracket 280. The strap 278 has an aperture formed therein to receive a pin 282. Spacer 284 maintains the strap 278 in alignment. Thus, the motor 265 with reduction gear 266 is pivotally connected to the cross member 265. The motor 265 is electrically controlled via conductors 286 from the controller 150 which, in turn, receives control signals from the control panel 102.

The extension 274 is here rotatably connected by a pin 288 to a cantilever 290 that is secured such as by welding to a cross member 292. The cross member 292 is connected to extend between and to be secured such as by welding to the right foot 34 and the left foot 160.

Figure 5:
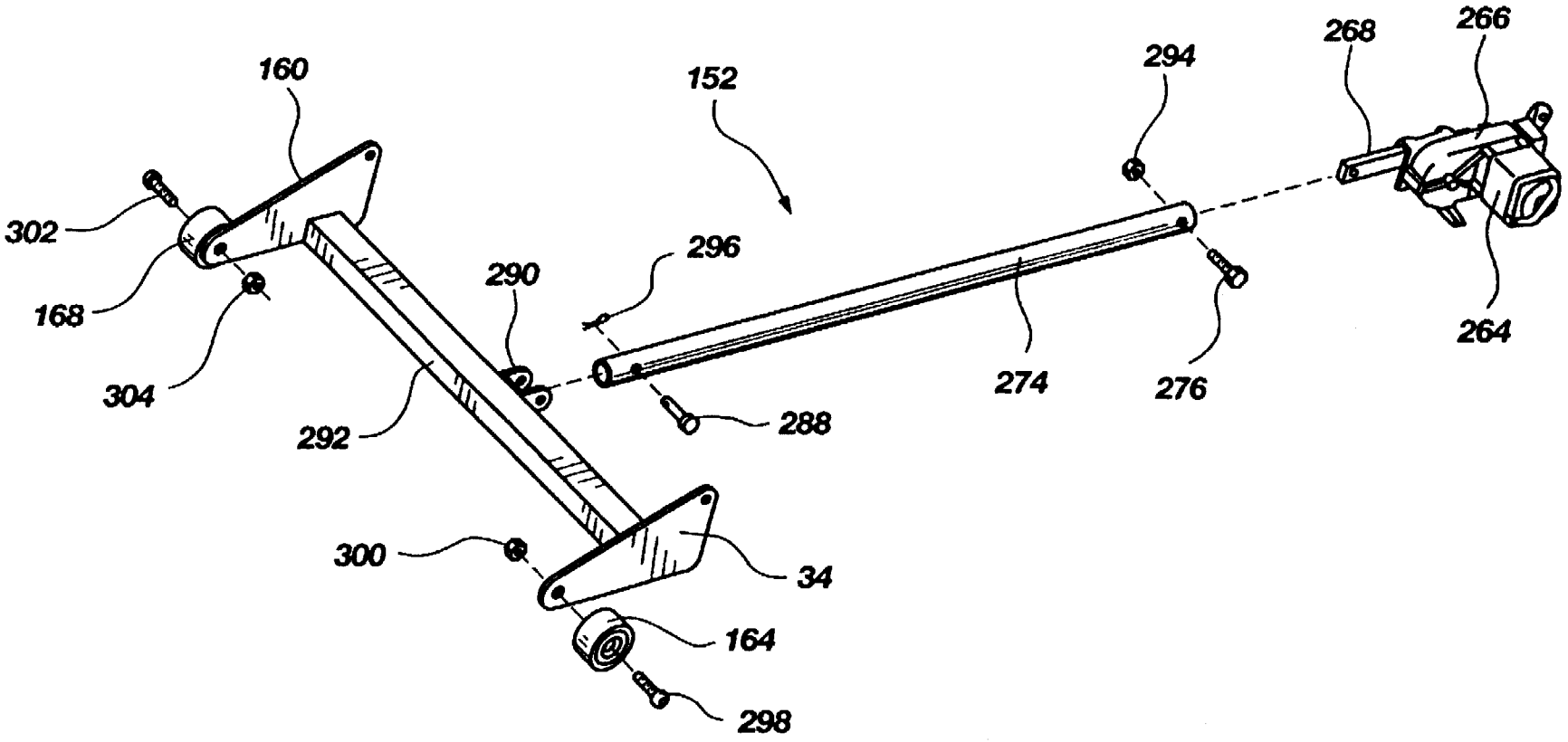
FIG. 5 is a partial perspective exploded view of an inclination assembly for use with the treadmill of the present invention to vary the inclination of the treadmill base relative to the support surface.

As better seen in FIG. 5, the rack 268 is connected by a pin 276 which is here secured by a threaded nut 294 or by a compression nut (not here shown). Similarly, the extension 274 is rotatably connected by pin 288 to the cantilever 290 by a pin 288 held in place by a cotter pin 296.

As also seen FIG. 5, the right foot 34 has wheel 164 secured thereto by a bolt 298 secured in place by nut 300. The left leg 166 has a left wheel 168 secured thereto by bolt 302 and nut 304.

Figure 6:
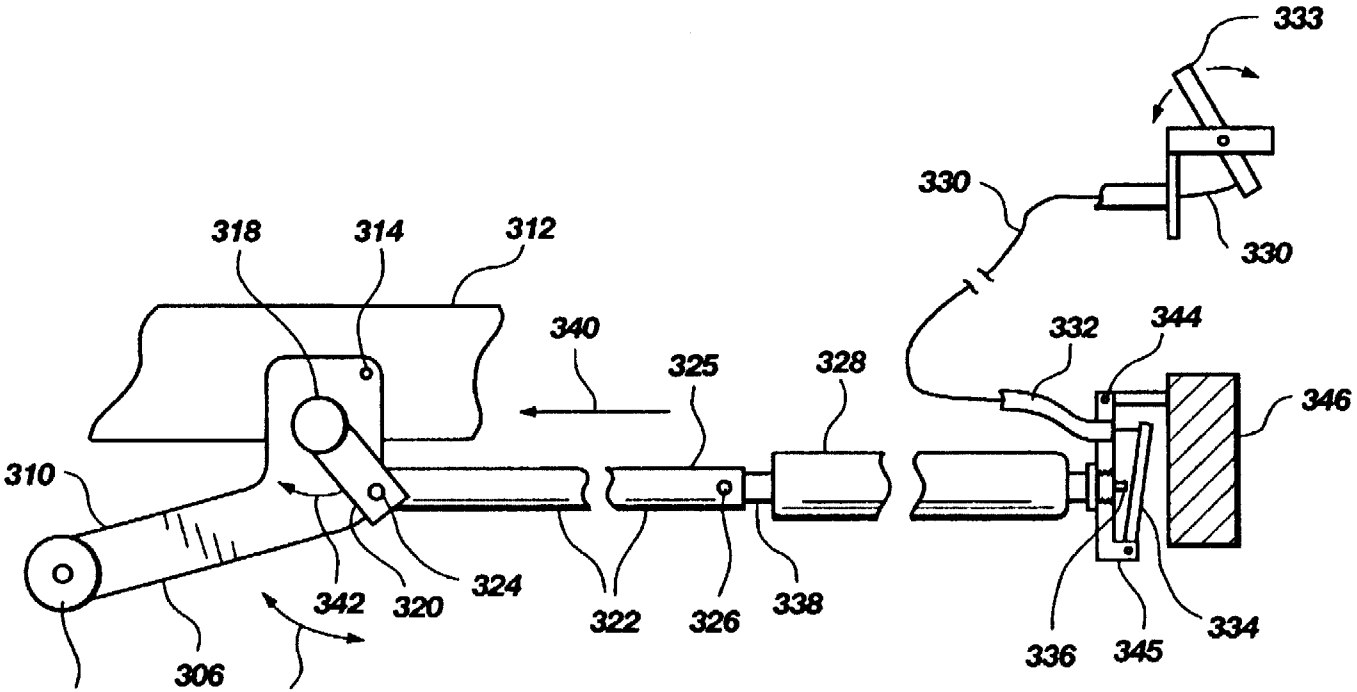
FIG. 6 is a partial schematic side view of an inclination assembly for use with a reorienting treadmill of the present invention.

An alternate configuration of an inclination system is shown in FIG. 6. A leg 306 with a wheel 308 appended at its distal end 310 is rotatably secured to a side 312 of a tread base to rotate about an axle 314. A cantilever 320 is secured such as by welding to the cross member 318. An extension 322 is rotatably attached to the cantilever 320 to rotate about a bolt or pin 324.

The extension 322 is connected at its proximal end 325 by a pin or nut and bolt 326 to a pneumatic spring 328. The pneumatic spring 328 contains gas under pressure, a chamber and a movable piston.

The pneumatic spring 328 is operable by operation means which here includes an actuation means. More specifically, the operation means includes a cable 330 within a sheath 332. The cable 330 is connected to actuation means such as actuator 333 for operation by a user positioned on the endless belt of the tread deck when the tread deck is positioned in the first position for use in performing exercises. Movement of the actuator 333 causes the cable to move, in turn, operating the lever 334 to contact a pin 336 associated with the pneumatic spring 328. Compression of the pin 336 operates the cylinder to cause the piston rod 338 to extend or retract to thereby move rearward 340 or forward thereby causing the cantilever 320 to rotate clockwise 342 and, in turn, cause the cross member 318 to rotate 319 clockwise (increase inclination) or counter clockwise (to decrease inclination) as here shown in FIG. 6. Rotation of the cross member 318 clockwise 342 causes the foot 306 to rotate relative to the side 312 and, in turn, the endless belt to in turn vary the inclination of the side 312 and the endless belt relative to the support surface.

In order to increase the elevation, the user may move his weight rearward on the endless belt. That is, the user may move (such as in FIG. 1) from the forward portion of the tread base towards the rear portion of the tread base to, in turn, vary the lever arm and increase the force downward on the foot 306 to, in turn, urge the extension 322 inward or outward and, in turn, cause the inclination to increase or decrease. The force of the user moving rearward on the front deck is sufficient to overcome and exceed the force being exerted by the pneumatic spring 328. It can be seen that the pneumatic spring 328 is secured to a bracket 345 that is rotatably attached by a pin 344 to a cross member 346 which is secured to and in between the opposite sides of a tread base (not here shown) such as side 312.

Figure 7:
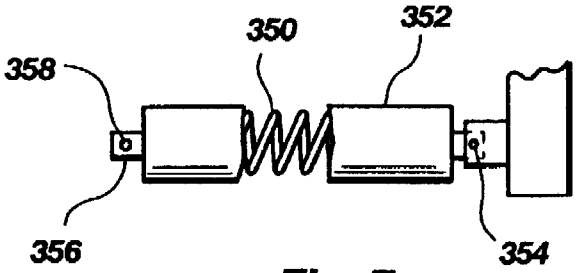
FIG. 7 shows a portion of an inclination structure for use with a reorienting treadmill of the present invention.

In reference to FIG. 7, instead of a pneumatic cylinder, a coil spring 350 is positioned within a cylindrical housing 352 shown in cutaway. The cylindrical housing 352 is rotatably attached to rotate about a pin 354 at one end. The cylindrical housing 352 also has an extension 356 with an aperture 358 for rotatable connection to an extension such as extension 322.

Figure 8:
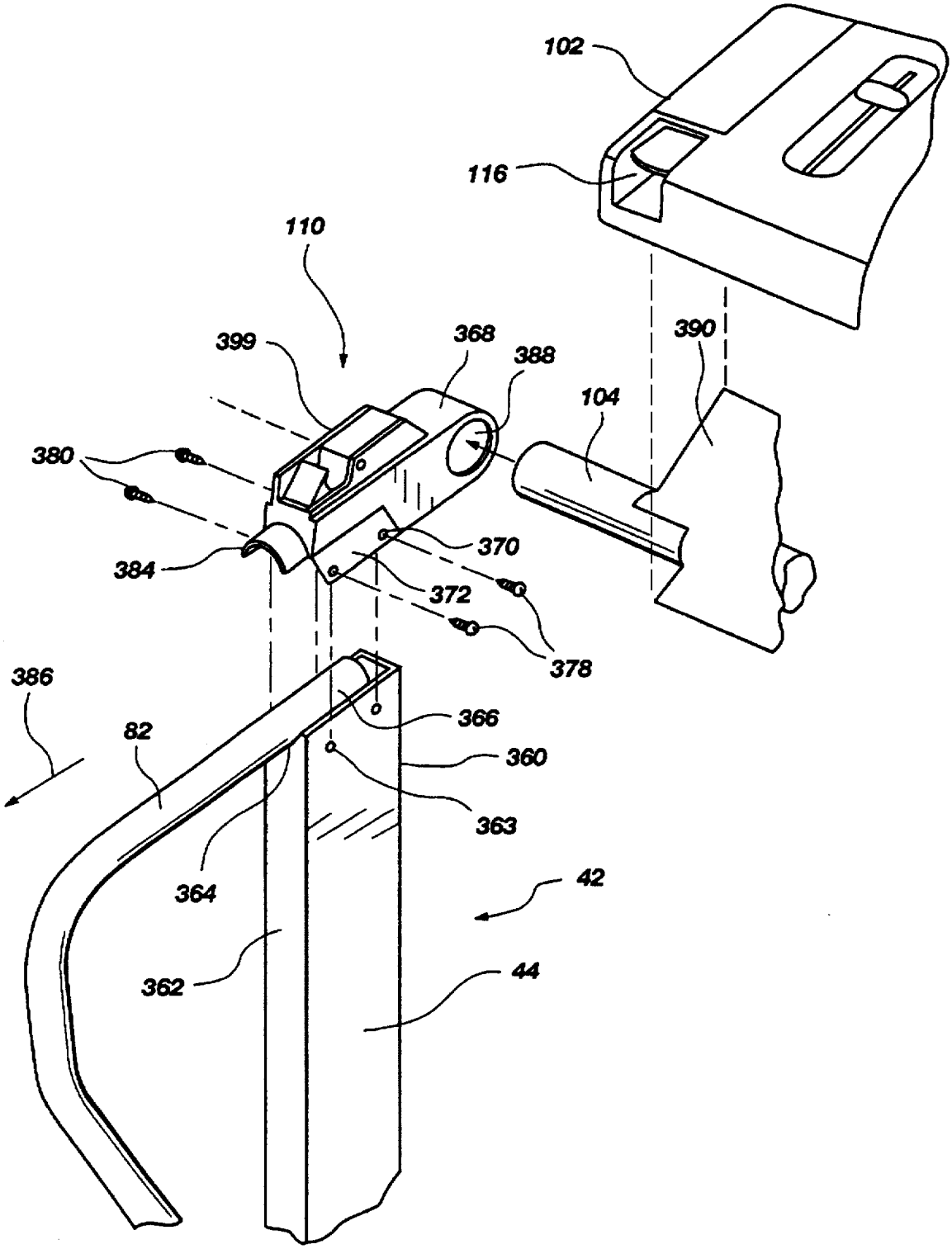
FIG. 8 is a partial perspective of a portion of a reorienting treadmill including a latching structure associated therewith.
Figure 9:
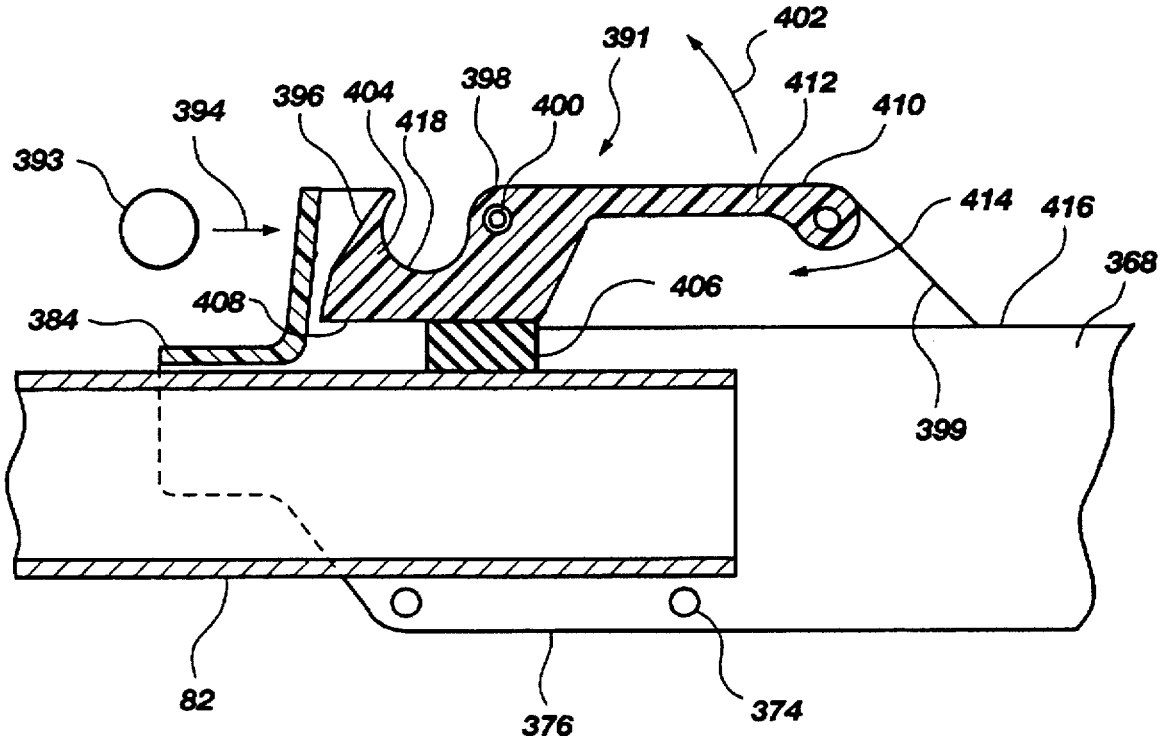
FIG. 9 is a partial cross sectional view of a latching structure of the type shown in FIG. 8.

In operation, the spring mechanism of FIG. 7 may be used to vary the inclination of the endless belt of the tread base by the user varying the rotation of associated feet, such as foot 306. The foot may be pinned by positioning a pin or bolt through an aperture passing through one or both sides of the tread base, such as side 312, and one of a plurality of apertures formed in the foot such as foot 306. The user may use his hand or his foot to apply downward pressure to the tread base in order to vary the inclination to overcome the force of the spring 350. Turning now to FIG. 8, the latching mechanism 110 is here shown in an exploded view in association with the left upright member 44 of the upright structure 42. As can be seen in FIG. 8, the upward or distal end 360 of the upright 44 reveals that the upright 44 is, in fact, a hollow rectangular channel. One surface 362 of the upright 44 is formed with an arcuate recess 364 formed to receive the circular in cross section left non-movable rigid handle 80 and more particularly the first portion 82 of the left non-movable handle. The inner end 366 of the first portion 82 is positioned within the hollow portion of the upright 44 as shown. A top clamp 368 is sized and configured to snugly fit over the distal end 360 of the upright 44. The top clamp 368 has apertures 370 formed in one side 372. Similar apertures 374 are formed in the opposite side 376 (FIG. 9). Associated screws 378 and 380 pass through the apertures 370 and 374 to register with corresponding apertures 363 formed in the upright 44 to secure the top clamp 368 and the inner end 366 thereto.

As can be seen, the top clamp 368 has a semi-circular portion 384 formed to register with the first portion 82 of the left rigid handle structure to snugly hold the first portion 82 of the left rigid handle structure 80 in place and to resist or inhibit outward 386 movement of the first portion 82 of the left rigid handle structure.

In FIG. 8, it can also be seen that the top clamp 368 securely receives the cross member 104 into an appropriately sized aperture 388. The support bar 104 is sized in cross section to snugly and slidably insert into the aperture 388. A base 390 is shown secured or fastened to the support bar 104. The base 390 is fastened by either welding, gluing, brazing or similar means as desired. The control console 102 is fastened to the base 390.

As hereinbefore discussed, the treadmill 10 of the present invention may include latching means adapted to the tread base 12 and to the upright structure 42. The latching means is operable for releasably attaching the tread base 12 in the second position to the upright structure 42. The latching means includes a receiving mechanism 391 which is configured to receive a latch member such as latch bar 393 (FIG. 4). The latch member is configured to removably connect to the receiving mechanism 391. As here shown, the receiving mechanism 391 is attached to the top clamp 368 which functions as a housing. The top clamp 368 is positioned at the distal end 360 of the left upright 44.

The latch member is shown in FIG. 4 to be a cylindrically shaped bar 393 that extends outwardly and normally from the left side 16. As the tread base 12 is rotated upwardly from the first position towards the second or storage position, the latch member 392 moves inwardly 394 towards the cam surface 396 of lever member 398. As here seen, the lever member 398 is rotatably attached to the top clamp 368 within a housing 399 to rotate about a pin 400 that functions like an axle. The lever member 398 rotates between a first position, as shown in FIG. 9, and a second position in which the lever member 398 is rotated counterclockwise 402. That is, the latch member is urged against the cam surface 396 thereby generating a force to urge the cam end 404 of the lever member 398 downwardly against a resistance. That resistance is here provided by a spring means. The spring means may be any form of acceptable spring, including a coil spring, a leaf spring or even a clock spring associated with the pin 400. However, as illustrated in FIG. 9, the spring as here shown is a block of an elastically deformable polyurethane sponge 406 or any other rubber-like or elastically compressible substance. In other words, any acceptable spring may be used to urge the lever member 398 from a displaced or second position to the at rest or first position as shown in FIG. 9.

The lever member 398 has a lower surface 408 configured to act against the sponge 406 to compress it upon counterclockwise rotation 402. Counterclockwise rotation 402 can also be effected by grasping the handle means 410 formed at a distal end 412. The handle mean is formed by shaping the distal end 412 to provide a space 414 between the distal end 412 and the upper surface 416 of the top clamp 368 so the user may place one's finger about the distal end 412 and, more particularly, about the handle 410 in order to urge it in a counterclockwise direction 402 out of the housing 399. Therefore, the lever member 398 may be manually rotated so that the latch member may be moved from the receiving portion 418. As here seen, the receiving portion 418 is a cylindrically shaped recess sized and shaped to receive the cylindrically shaped bar 393.

In use, the tread base 12 may be moved from the first position as shown in FIG. 1 to the second position shown or storage position in FIG. 2. In moving from the first position to the second position, the bar 393 is urged against the cam surface 396 as hereinbefore stated. The user may grasp the left rigid handle structure 80, the right rigid handle structure 90, or both, while pushing on the rear end 22 or the rigid surface 32 to urge the tread base 12 and, in turn, the latch member into the receiving portion 418. Upon entry of the latch member into the receiving portion 418, the spring means or sponge 406 may operate to urge the lever member 398 from a displaced position (not shown) to the first position as shown in FIG. 9.

Those skilled in the art may recognize that other forms and shapes of a receiving portion 418, as well as a latch member, may be used in order to facilitate an automatic latching arrangement of the type herein described. Similarly, the lever member 398 may be configured in a variety of shapes in order to permit displacement by a latch member on a cam surface following which the latch member enters a space or area provided to inhibit movement of the latch member from that space.

It may also be recognized that the lever member 398 may be positioned either on the distal end 360 of the left upright 44 or similarly on the distal end 91 of the right upright 46. Similarly, the lever 398 with a housing may be positioned on the tread base 12 to intersect with a latch member associated with the left upright 44 or right upright 46, as desired.

Figure 10:
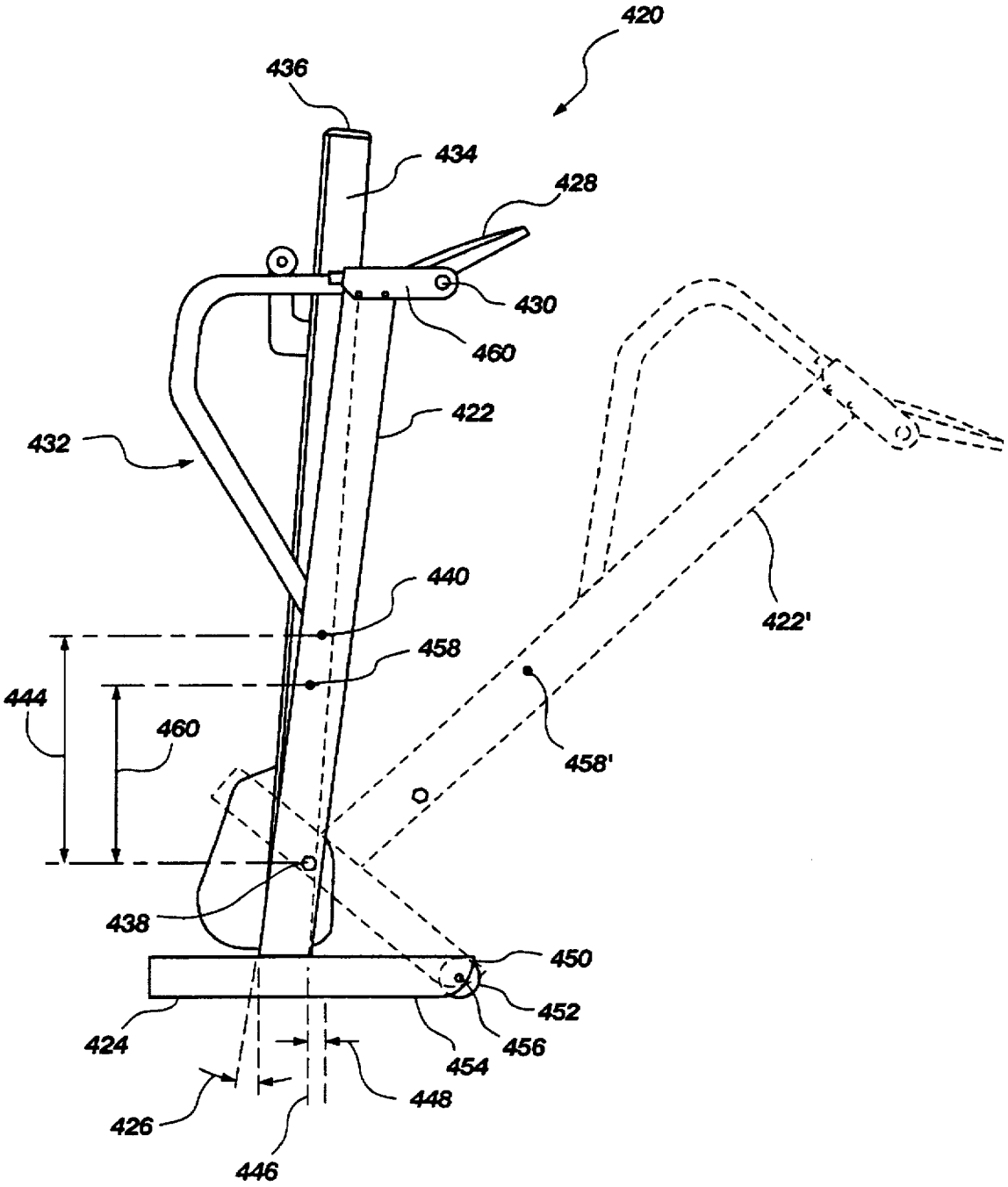
FIG. 10 is a partial side view of a reorienting treadmill of the present invention with the tread base oriented in a second or stored position and with the treadmill shown in phantom oriented for movement.

Turning now to FIG. 10, a simplified representation of a reorienting treadmill 420 is shown similar to the treadmill 10 shown in FIG. 1. The treadmill 420 is shown from the side view with a right upright 422 connected to a right foot 424 at an angle 426 here shown to be about 15°. The angle 426 may be from about zero to about 25 ° The angle 426 is selected in order to position the center of gravity 440 of tread base 434, as well as the center of gravity 458 of the overall treadmill, as more fully discussed hereinafter.

As can be seen in FIG. 10, the illustrated treadmill has a control panel 428 connected to a cross support 430 which extends between the right upright 422 and the left upright (not shown). The treadmill 420 also has a right rigid handle structure 432 connected to the right upright 422. It also similarly has a left rigid handle structure connected to the left upright (not here shown). As here shown, the tread base 434 has a rear end 436 which extends upwardly as shown when the tread base 434 is positioned in the second or storage position as shown in FIG. 10.

The tread base 434 is rotatably connected to rotate about a base axis 438. The center of gravity 440 of the tread base 434 is positioned to be spaced upwardly 444 from the base axis 438. That is, from FIG. 4 it can be seen that the tread base 12 (FIG. 1) and similarly the tread base 434 have mass. Various components such as the motor 138 and electronics 150 (FIG. 4) are positioned so that the center of gravity 440 of the tread base 434 is above base axis or axis of rotation 438. Thus, upon movement of the tread base 434 from its first position to its stored or second position as shown in FIG. 10, the center of gravity 440 passes through vertical alignment 446 with the axis of rotation. The tread base 434 is rotated until the center of gravity 440 is displaced clockwise past the vertical 446 a distance 448 selected to stably retain the tread base 434 in the second position with or without a latching means as hereinbefore discussed. That is, the location of the center of gravity 440 of the tread base 434 clockwise past the vertical 446 creates a lever arm to hold the tread base 434 in the second or stored position as shown.

As hereinbefore stated, the center of gravity 440 is selected to be displaced above the axis of rotation 438 at a preselected distance 444. The distance 444 is selected so that the weight or mass of the tread base 434 when acting downwardly at the center of gravity 440 is displaced toward the axis of rotation 438 to minimize the amount of upward or lifting force needed at the rear end 436 to lift the tread base 434 and move it from the first position toward and into the second position. The location of the center of gravity 440 may vary based on the size, weight, construction and shape of each individual model of treadmill. However, the center of gravity 440 and more particularly the location of the center of gravity 440 is selected so that the total amount of lifting force necessary to lift the rear end 436 when the tread base 434 is in the first position is such that a normal user may be able to easily lift and rotate the tread base from the first position to the second position.

It may also be seen in FIG. 10, that the foot 424 has an angulated forward surface 450. The wheel 452 positioned in the front or forward end 454 of the right foot 424 is positioned to rotate about an axle 456. The wheel 452 is positioned so that it does not contact the support surface until the upright or support structure 422 is rotated or displaced from a first or standing position to a displaced position here shown in phantom as 420 with the upright identified as 422'.

It may be noted that in the standing position, the center of gravity 458 of the entire treadmill 420 is determined by the weight and mass of all of the components of the treadmill 420 and may be the same as or displaced from the center of gravity 440 of the tread base 434. The center of gravity 458 of the entire treadmill 420 is desirably positioned at a height or distance 460 which may be above or below the center of rotation 438 but nonetheless close to the center of rotation 438. However, it must be placed above the foot 424 in order to facilitate rotation of the treadmill 420 from the configuration and position shown in solid in FIG. 10 to that shown in phantom in FIG. 10.

Desirably, the center of gravity 458 is rotatable to a position 458' to be generally positioned over the axle 456 of the wheel 452 to minimize the downward force or the lifting force necessary to be exerted by the user when holding the treadmill 420 in the position shown in phantom in FIG. 10. Of course, the position shown in phantom in FIG. 10 is the position for moving or pushing the treadmill 420 about the support surface from one location to another.

The treadmill of FIG. 10 is formed to have a left handle and a right handle available for grasping by the user to facilitate holding and moving the treadmill 420 when in the position shown in phantom in FIG. 10. The left handle and the right handle may be any structural component readily available for grasping by the user, while the user is moving the treadmill 420 when the treadmill 420 is in the orientation shown in phantom in FIG. 10. More particularly, the rigid handle structure 432 on both the left and the right side may be grasped by the user potentially along the first portion such as the first portion 92 and 82 of the rigid handles shown in FIG. 2 and in FIG. 1. Similarly, the user may be able to grasp and hold a portion of the support bar 430 in order to hold on to and urge or move the treadmill 420 when supported on the right wheel 452, as well as the corresponding left wheel (not here shown). Also, a portion of the top clamp 368 as well as the bracket 114 shown in FIG. 4, extends outwardly or over the respective distal ends 81 and 91 of the upright supports 44 and 46. That is, the clamp 460 shown in FIG. 10 and the clamp on the left side (not shown) may be grasped by the user to support and hold the treadmill 420 for movement about the support surface while supported by the wheel 452 on the right side, as well as a wheel similarly positioned on the left side.

Figure 11:
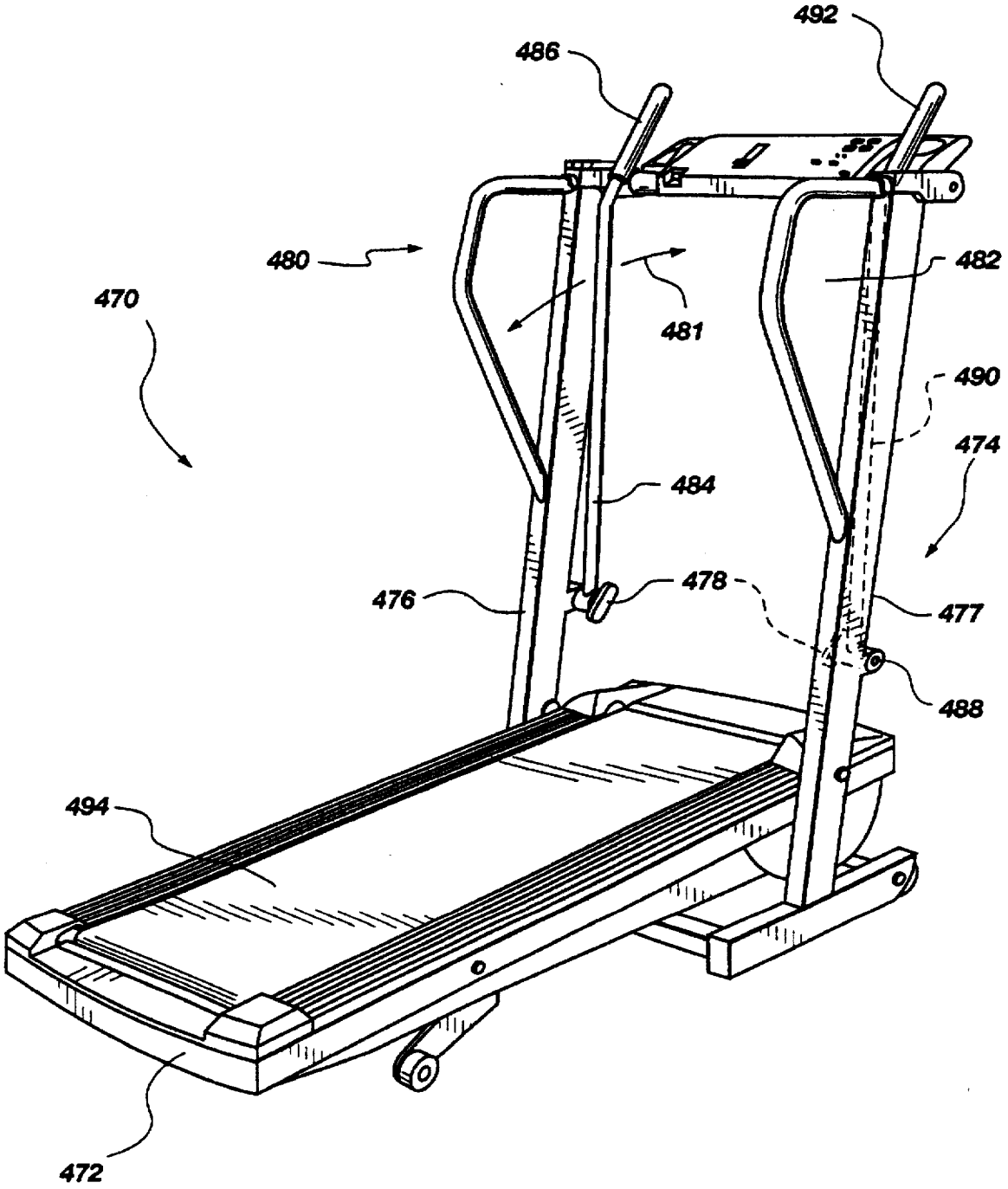
FIG. 11 is a perspective view of an alternate embodiment of a reorienting treadmill of the present invention with movable handles and with the tread base oriented in a first position to receive a user for performing exercises.

Turning now to FIG. 11, an alternate configuration of the treadmill 470 has a tread base 472 comparable to tread base 12 in FIGS. 1 and 2. Similarly, it has support structure 474 including a left upright 476 and a right upright 484. It also has left rigid handle structure 480 and right rigid handle structure 482. As also shown, the treadmill 470 has a movable left handle 484 which is rotatably attached to the left upright 476 with a hand-operated knob 478 useful to tighten or secure the handle 484 and increase resistance or decrease resistance to rotation. As can be seen, the handle 484 has a gripping portion 486 configured for grasping by a user. A right handle 490 is here shown to be pivotally attached at an axis 488 to rotate thereabout. The right handle 490 also has a grip portion 492 positioned for grasping or movement by a user in a back and forth 484 or pivotal movement when the user is positioned on the endless belt 494.

Returning now to FIG. 4, it may also noted that the tread base 12 has a deck 500 which extends between and is connected to the left side 16 and the right side 18. The tread deck 500 may be formed of any acceptable rigid material which may be acceptable plywood materials with a wax or slippery upper surface over which the endless belt 24 is trained and moves.

It may also be noted that the tread base 12 of FIG. 4 has a rear pulley 502 connected to extend between the left side and the right side. The rear pulley 502 is adjustably positioned and movable forwardly and rearwardly by a bolt structure 504 on the left side. On the right side, a bolt structure 506 with an associated spring 508 is provided to provide movable or adjustable tension to the rear pulley 502 so that in use, the endless belt remains centered on the front pulley 252 and the rear pulley 502. Similarly, guides 510 and 512 may be secured to the deck 500 to extend away therefrom. The return portion 513 of the endless belt 24 may ride against the guides 510 and 512 to further facilitate centering of the endless belt 24 on the front pulley 252 and rear pulley 502.

It may be also noted from FIG. 4 that the tread base 12 has a length 514 which is here selected to facilitate performance of walking, jogging or running exercises as desired. That is, the length 514 may vary for treadmills configured for walking and treadmills configured for jogging and running. In turn, the length of the tread 24 itself will vary as desired.

To use the reorienting treadmill of FIGS. 1, 2 and 4, it can be seen that the user must first move the tread base 12 from the upright or the stored position shown in FIGS. 2 and 4, to the first or operating position shown in FIG. 1. In the first or operating position, the user stands on the endless belt 24 and walks, jogs or runs to perform exercises. If the user desires to vary the inclination, the user may operate the switch on the control panel 102 to electrically operate the electrical auto-incline system shown in FIGS. 5 and 4. Alternately, the user may operate or manipulate an actuation member to, in turn, actuate a pneumatic spring of an inclination system such as that shown in FIG. 6 and move his or her weight back and forth on the endless belt to vary the downward movement and control inclination. Upon selection of the desired inclination, the user may, thereafter, operate control panel 102 through the use of safety switches and operating switches to energize the motor, such as motor 138 to, in turn, power the tread while performing exercises. In order to operate the treadmill in an electric configuration, the user must obviously provide energy to the system by inserting the plug 516 (FIG. 4) into a conveniently available wall outlet.

Figure 12:
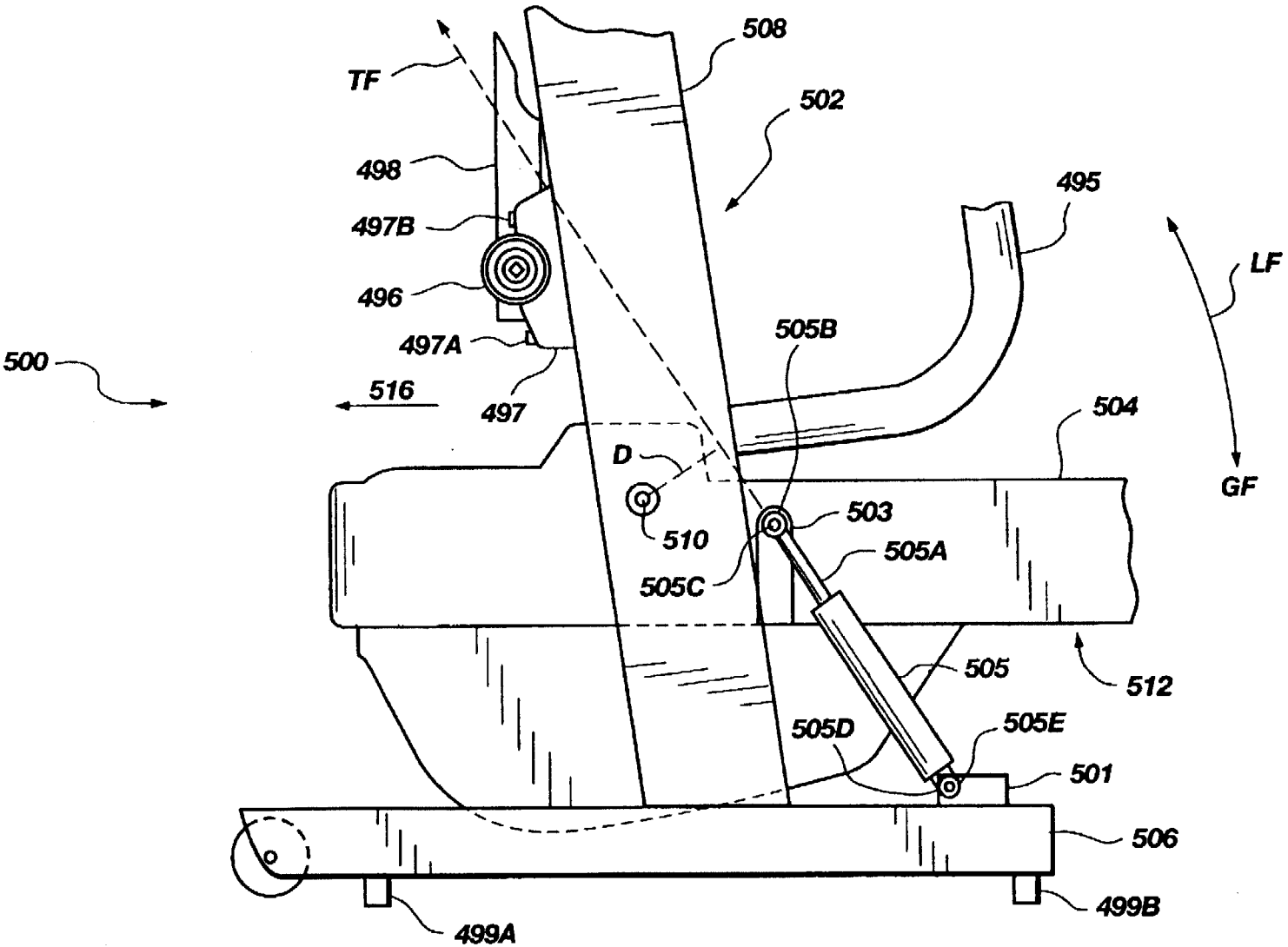
FIG. 12 is a simplified partial side view of an alternate reorienting treadmill of the present invention having lift assist means and with a tread base in a first position.
Figure 13:
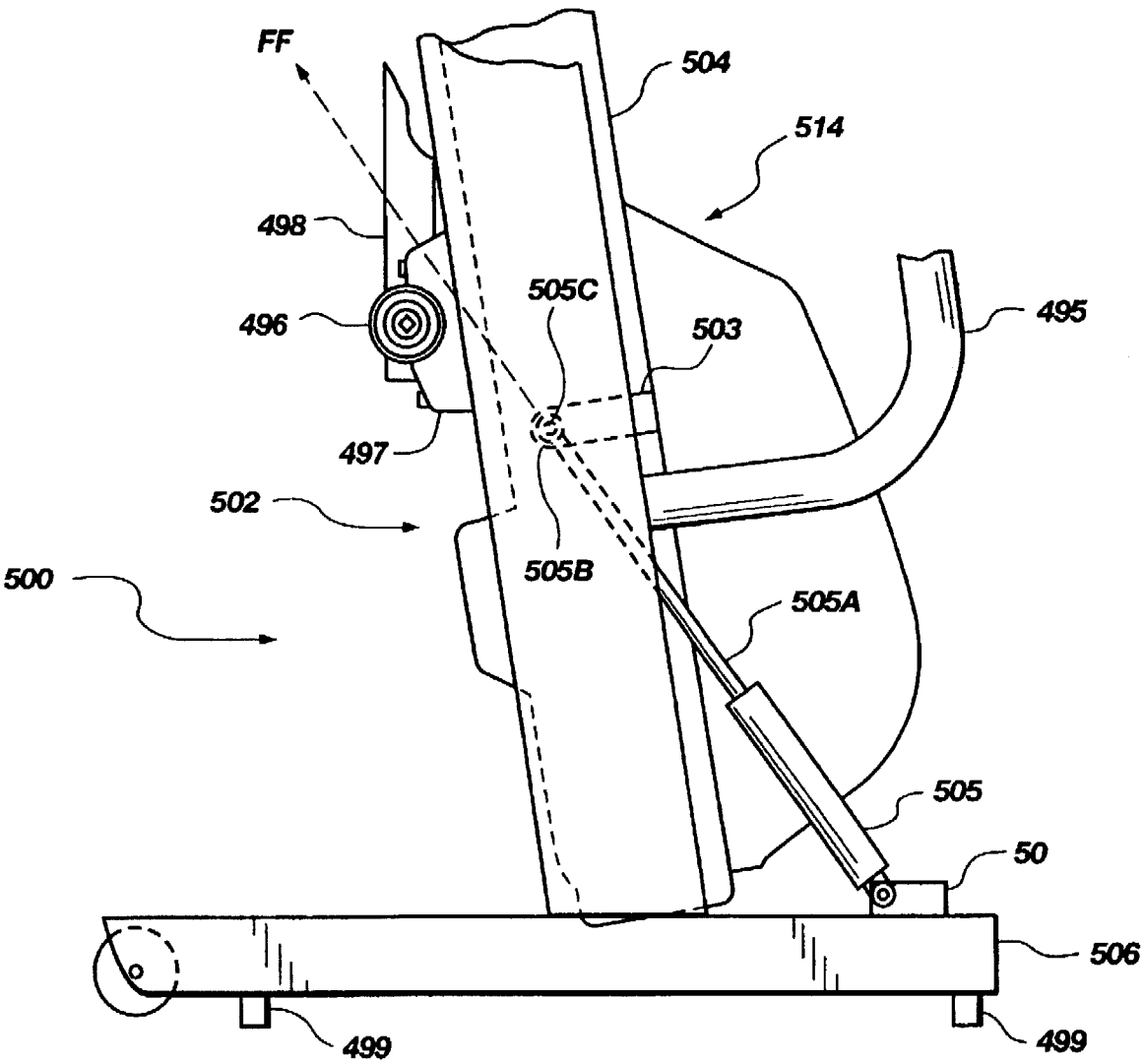
FIG. 13 is a simplified partial side view of the reorienting treadmill of FIG. 12 with a tread base in a second or stored position.

Referring now to FIGS. 12 and 13, an alternate reorienting treadmill 500 is shown. The reorienting treadmill 500 is similar to the treadmill of FIGS. 1, 2 and 4. It has support structure 502 with a tread base 504. The support structure 502 has a left foot 506 and a comparable spaced apart right foot (not shown) with interconnecting cross supports (not shown) to define a footprint similar to the footprint for the treadmill of FIGS. 1 and 2. The support structure 502 also has a left upright 508 and a spaced apart right upright (not shown), each secured to the respective left foot 506 and right foot by any means to provide a secure connection. Welding, bolts or the like are contemplated as acceptable means.

The tread base 504 is rotatably attached to and between the left upright 508 and the right upright such as by bolts 510 or other similar pins, bars or the like to function as an axle. The tread base 504 is rotatable between a first position 512, seen in FIG. 12, and a second or stored position 514, seen in FIG. 13. The tread base 504 rotates about the bolts 510.

For some users, the amount of lifting force (LF) necessary to rotate the tread base 504 upward or counterclockwise (as shown) from the first position 512 toward the second position 514, may be large enough so that rotation is difficult.

In some configurations, components such as an inertia wheel or motor may be located forwardly 516 and, more specifically, forward 516 of the bolts 510. The weight of such components and the related portion of the tread base 504 forward 516 of the bolts 510 will act as a counterbalance to reduce the lifting force (LF) required to reorient the tread base 504 between the first 512 and second 514 positions.

In FIGS. 12 and 13, a lift assistance assembly is also provided to apply a force or torque urging the tread base 504 from the first position 512 toward the second position 514. More specifically, a gas spring 505 is rotatably attached at one end to bracket 503 secured to the tread base 504. That is, the piston rod 505A has a bushing 505B that is attached by a pin or bolt 505C. At its other end, the gas spring 505 is attached to bracket 501 which is itself attached to the left foot 506 or a cross member (not shown) extending between the left foot 506 and the right foot. Alternatively, the gas spring may be attached to the right foot and the right side of the tread base 504 (not shown). The gas spring 505 has a bushing 505D held to the bracket 501 by a pin or bolt 505E. In operation, the gas spring 505 applies a torque force (TF) in the direction illustrated. The torque force (TF) is spaced from the axle bolts 510 a distance D that may be varied to increase the leverage and in turn the torque in foot-pounds. That is, gravitational forces (GF) are exerted on the mass of the tread base 504 to develop a torque, causing the tread base 504 to rotate toward the first position. The force and the torque (TF) exerted by the spring 505 is selected so that the resulting required lifting force (LF) may be nominal (e.g. 5 to 20 pounds). FIGS. 12 and 13 also show the left foot 506 with a plurality of floor supports 499A and 499B attached thereto and extending therebelow for contact with the support surface. The floor supports 499A and 499B are preferably made of a material that may have a high coefficient of friction to avoid sliding or walking of the machine on the support surface. The floor supports 499A and 499B are also sufficiently soft to reduce the risk of scratching or marring a support surface such as wood or tile.

A pivotal handle 498 is also shown rotatably attached by a bracket 497 fixedly secured to the upright 508 by bolts 497A and 497B. A resistance knob 496 is also shown that is operable by the user to vary the resistance to movement of the handle 498. A fixed handle 495 is also shown in FIGS. 12 and 13.

Figure 14:
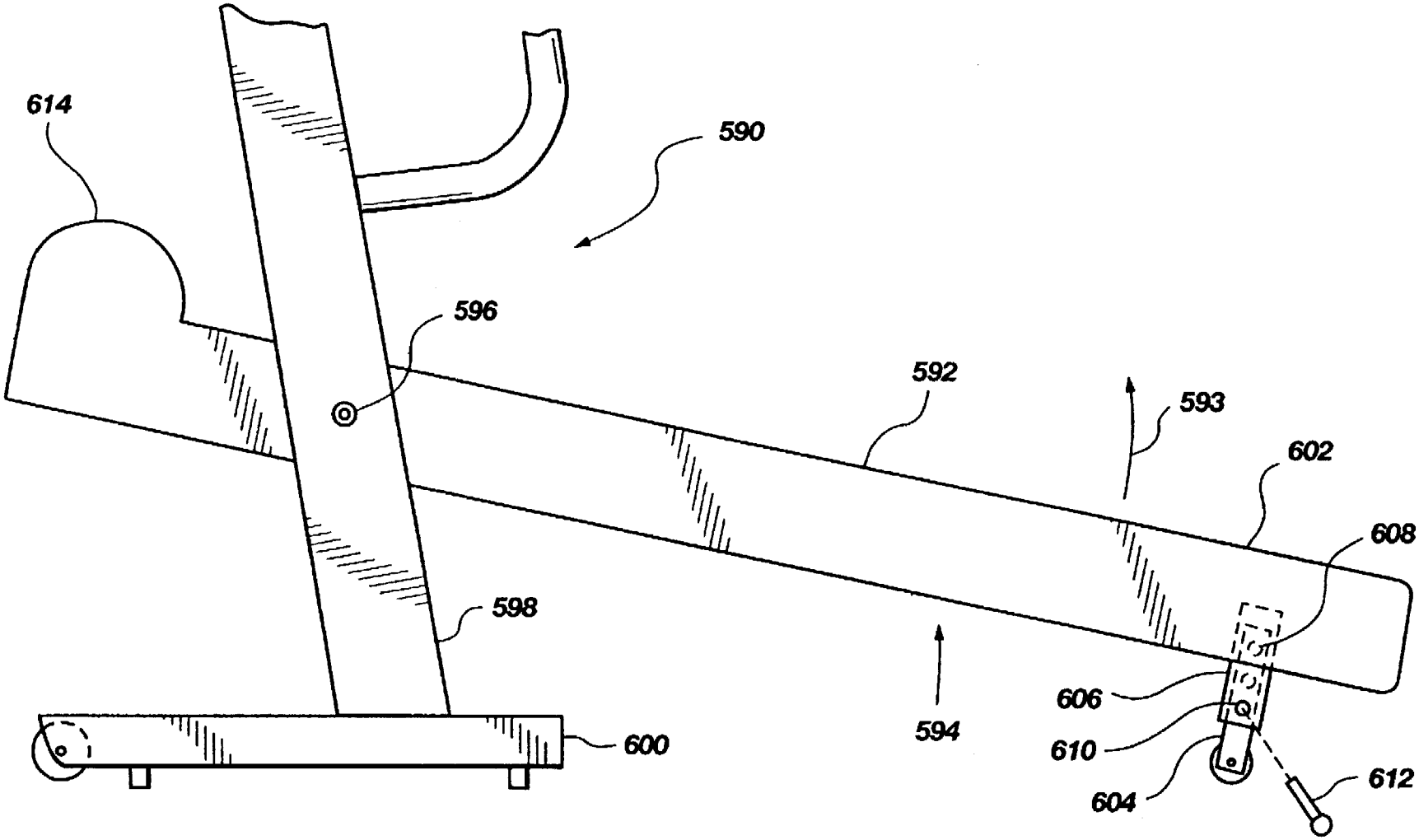
FIG. 14 is a simplified partial side view of an alternate reorienting treadmill of the present invention having elevation structure associated with the tread base in its first position.

Referring now to FIG. 14, an alternative form of reorienting treadmill 590 is shown. It has a tread base 592 that is reorientable 593 from a first position 594 to a second position similar to the treadmills of FIGS. 1 and 2. The tread base 592 rotates 593 about bolts 596 which are attached to left upright 598 and right upright (not shown). The left upright 598 and the right upright (not shown) are each attached to a respective left foot support 600 and a right foot support (not shown). Near the rear 602 of the tread base 592, a pair of spaced apart supports are attached to support the tread base on a support surface. The left and right supports each have a leg 604 that is snugly and slidably movable in a housing 606. The leg 604 has a plurality of apertures 608 which can be placed in registration with an aperture 610 in both sides of the housing. A pin 612 is insertable through the apertures 610 and 608 to position the leg 604 at a selected distance from the tread base 592 and to, in turn, vary the inclination of the tread base 592 relative to the support surface.

The treadmill 590 of FIG. 14 is shown with a flywheel housing 614 at its front end. The flywheel is connected to the endless belt (not shown) and receives energy from the user operating the endless belt of the tread base 592. It also delivers energy to that endless belt as the user performs walking, running or jogging exercise when the user is suspended and not in contact with the endless belt.

Figure 15:
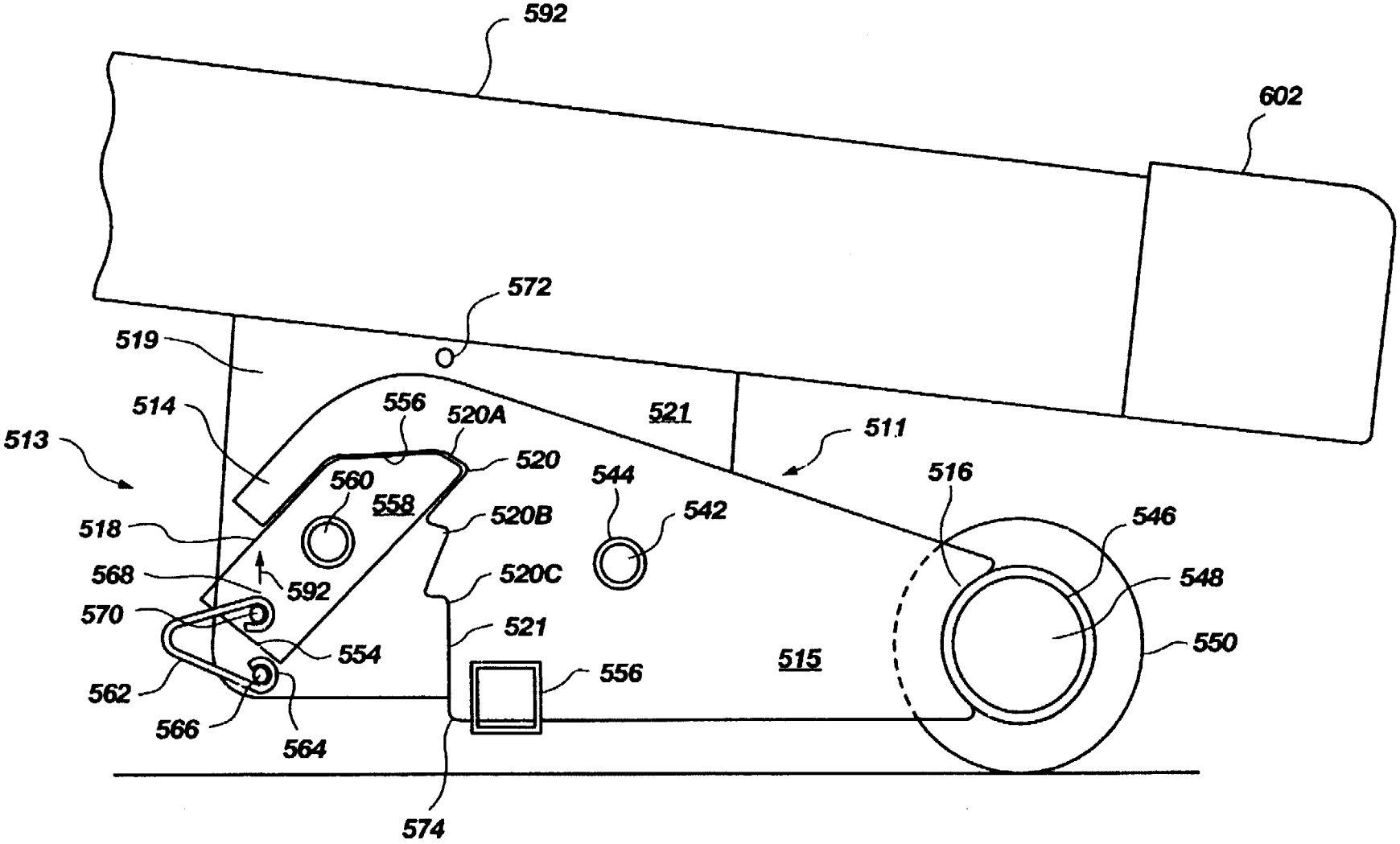
FIG. 15 is a simplified side view of the alternate reorienting treadmill of FIG. 14 with alternate elevation structure.
Figure 16:
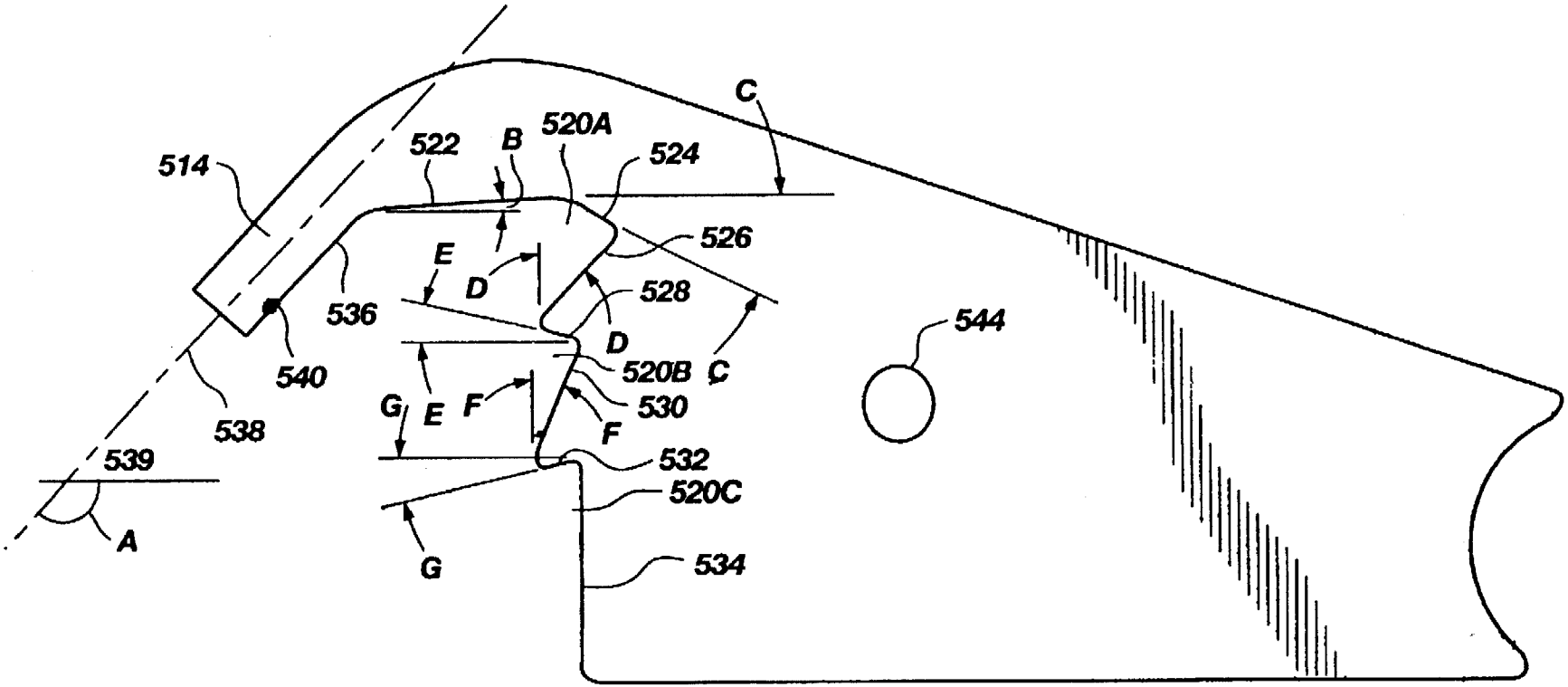
FIG. 16 is a simplified side view of portions of the alternate elevation structure of FIG. 15.

Turning now to FIGS. 15 and 16, an alternate elevation system 511 is shown attached proximate the rear 602 of tread base 592. The elevation system may have two spaced apart assemblies comparable to the assembly 513 shown. The assembly 513 has a generally rectangular planar member 519 which is secured to the tread base 592 in a generally vertical orientation. The planar member 519 may be fabricated of metal and secured to the metal frame of the treadmill by bolts, welding or the like.

The assembly 513 has a support 515 that is an elongate planar member having a first end 514 and a second end 516. The first end 514 is shaped to be an elongate finger-like extension which functions as a stop for the pawl 518. The support 512 further has a ratchet section having a plurality of recesses or notches 520 along its perimeter. In the support 515 illustrated in FIG. 15, three distinct notches 520A, 520B and 520C are formed in the perimeter 521. In other configurations, 2 or 4 or more notches may be present. The first notch 520A substantially corresponds to the perimeter of a section of the pawl 518 whereby the pawl 518 may be surrounded on a plurality of its sides when that pawl 518 is inserted into the first notch 520A.

The second notch 520B is defined by the sides 528 and 530 of the perimeter 521 of the support 515. The third notch 520C is defined by the sides 532 and 534 of the support 515.

The extension 536 may be viewed as being substantially a rectangularly configured section having a longitudinal axis 538 which is oriented to a horizontal axis 539 at an angle A. Given the essentially rectangular configuration of extension 536, it should be understood that linear side 540 would also be oriented at an angle A to the horizontal. In a preferred construction, angle A may be within the range of 125 to 136 degrees and preferably 131 degrees.

The side 522 which extends from side 540 is oriented at an angle B from the horizontal. In preferred constructions, angle B may be within the range of zero to ten degrees, preferably four degrees. Side 524, which extends from side 522, is oriented at an angle C from the horizontal. Angle C is within the range of 22 to 34 degrees and preferably approximately 28 degrees. Side 526 which extends from side 524 is oriented at an angle D from the vertical. In preferred constructions, angle D may be within the range of 36 to 48 degrees and preferably 43 degrees.

Side 528 which extends from side 526 is oriented at an angle E from the horizontal. In a preferred construction, angle E is within the range of four to 15 degrees and preferably nine degrees. Side 530, extending from side 528, defines an angle F from the vertical. Angle F is preferably within the range of 17 to 29 degrees and preferably 23 degrees. Side 532, which extends from side 530, is oriented at an angle G from the horizontal. Angle G is within the range of five to fifteen degrees and preferably ten degrees. Side 534, which extends from side 532, is oriented vertically upright, i.e., at an angle of 90 degrees to the horizontal. Sides 526 and 530 are dimensioned to provide sufficiently deep notches to enable the top of the pawl 518 to be received in the notches 520B and 520C and form a detachable union with each notch to retain the support in a fixed orientation relative to the exercise apparatus.

The support 515 is rotatably connected to the planar member 519 by means of a pivot axle 542. The pivot axle 542 is an elongate cylindrical member which extends outwardly and perpendicularly from the surface 521 of the planar member 519. The axle 542 extends through a circular aperture 544 formed in the support 515. The axle 542 may be fixedly secured to the planar member 519 while the support 515 is rotatable about the axle 542. Alternatively, the axle 542 may be fixedly secured to the support 515 and rotatably secured to the planar member 519. The axle 542 may also be rotatably secured to the planar member 519 while the support 515 is rotatably secured to the axle 542.

The end 516 of the support 515 may be adapted to a connection bar 546 which extends between two spaced apart supports. The opposing ends 548 of the bar 546 are fitted with end caps 550. The end caps 550 are preferably fabricated from a material having a high coefficient of friction. The end caps 550 rest directly on the support surface and form the point of contact between the incline adjustment mechanism and the support surface. The opposite supports may be further interconnected to one another by means of a spacer bar 556.

The pawl 518 is also a planar member having a somewhat rectangular configuration on one end 554 thereof and an angled surface 556 on its other end 558. The pawl 518 is rotatably secured to the planar member 519 by a pivot axle 560. Axle 560 may be configured as an elongate cylindrical shaft which is either fixedly or rotatably secured to the planar member 519 so that the pawl 518 is rotatable with respect to the planar member 519. A substantially V-shaped spring 562 is secured at its first end 564 to the planar member 519 by means of a pin 566. The end 564 is formed into a substantially circular configuration which in turn is wrapped around the pin 566. The opposing end 568 of the spring 562 is also formed into a generally circular configuration which in turn is also secured about a pin 570 which is affixed to the pawl 518. The spring 562 is constructed to exert a force in the direction of arrow 572. The spring 562 therefore urges the pawl 518, and more specifically, the surface 556 to rotate clockwise into abutment against the support 515 proximate the notches 520A, 520B and 520C of that support. Therefore, when the support 515 is rotated in a clockwise direction about axle 542, for example by the operation of gravity as the end 602 of the tread base 592 is lifted, the pawl 518 is urged against the perimeter 521 of the support 515 which defines the notches. As the surface 556 of the pawl 518 is urged into one of the notches, the pawl 518 forms a detachable connection with the support 515.

When the support 515 engages the support surface, such as a floor, the support 515 is urged to rotate in a counterclockwise direction about its pivot axle 542. Should the pawl 518 be secured in notch 520A of the support 515 counterclockwise rotation of support 515 is precluded by the pawl 518. When the end 602 of the treadmill is lifted vertically, the weight of the bar 546 and other components at the end 516 of the support 515 urges the support 515 to rotate clockwise about the axle 542. The spring 562 is configured such that the force applied to the pawl 518 is less than the torque or force urging clockwise rotation of the support 515.

In lieu of the spring 562, a weight may be attached to the pawl 518 to urge it to rotate clockwise from notch 520A to notch 520B and 520C, but to rotate counterclockwise when the pawl 518 is urged to a more upright orientation by corner 574. The operation of the assembly 513 is described more fully in U.S. patent application Ser. 539,249 filed Oct. 5, 1995, the disclosure of which is incorporated herein by reference.

It should be understood, however, that a non-motorized arrangement may also be used in which an inertia wheel comparable to a flywheel 140 is provided to provide or deliver torque or energy to the endless belt 24 while the user is walking, jogging or running.

Reference herein to the details of the illustrated embodiment is not intended to limit the scope of the claims which themselves recite those features which are regarded as essential to the invention.

What is claimed is:

1. A treadmill comprising:

support structure having feet means for stably positioning on a support surface to be free standing and having upright structure extending upwardly from said feet means;

a tread base having a frame that includes a front, a rear, a left side, a right side and an endless belt positioned between said left side and said right side, said frame being connected to said support structure to be moveable about an axis of rotation spaced from said front toward said rear between a first position in which said endless belt is positioned for operation by a user positioned thereon and a second position in which said rear of said frame is positioned toward said support structure;

handle means associated with said support structure positioned for grasping by a user for moving said support structure with said tread base in said second position between a use position in which said support structure has said feet means positioned on said support surface for stably positioning said support structure on a support surface and a moving position in which said support structure is rotatably displaced from said use position;

roller means adapted to said feet means for engagement with said support surface when said support structure is reoriented to said moving position for movement of said support structure by the user on said support surface; and means for stably retaining said tread base in said second position relative to said upright structure with said tread base in said second position.

2. The treadmill of claim 1 wherein said feet means includes a left foot positioned proximate said left side and a right foot positioned proximate said right side, wherein said left foot and said right foot each have a forward end spaced outwardly from said upright member, and wherein said roller means includes a wheel rotatably attached to said forward end of said left foot and a wheel rotatably attached to said forward end of said right foot.

3. The treadmill of claim 2, wherein said upright structure includes a left upright member and a right upright member, said right upright member being spaced from and in general alignment with said left upright member.

4. The treadmill of claim 3, wherein said handle means includes a left handle mechanically associated with said left upright member and a right handle mechanically associated with said right upright member.

5. The treadmill of claim 4, wherein said treadmill has a center of gravity and wherein said left handle and said right handle are each positioned at a height spaced upwardly above the center of gravity of said treadmill.

6. The treadmill of claim 5, wherein said height is selected to provide leverage for the user reorienting said treadmill for moving it about a support surface with said support structure in said moving position.

7. The treadmill of claim 6, wherein said support structure includes a cross member extending to and between said left foot and said right foot proximate the respective forward ends thereof.

8. The treadmill of claim 7, wherein said tread base has a front portion extending from about a position midway between said front and said rear to said front, and wherein said front portion of said tread base is rotatably attached to said support structure.

9. The treadmill of claim 8, wherein said tread base is releasably attached to said support structure proximate said front portion.

10. The treadmill of claim 1, wherein said left side of said tread base is rotatably attached to said left upright member and said right side of said tread base is rotatably attached to said right upright member.

11. The treadmill of claim 1, wherein said feet means is formed to have a footprint configured to stably support said treadmill with said tread base in said second position.

12. The treadmill of claim 1 wherein said means for stably retaining said tread base in said second position includes providing said tread base with a mass configured to position the associated center of gravity of said tread base to stably retain said tread base in said second position when said tread base is moved to said second position.

13. A treadmill comprising:

support structure having feet means for stably positioning on a support surface to be free standing and having upright structure extending upwardly from said feet means;

a tread base having a frame that includes a front, a rear, a left side, a right side and an endless belt positioned between said left side and said right side, said frame being connected to said support structure to be movable between a first position in which said endless belt is positioned for operation by a user positioned thereon and a second position in which said rear of said frame is positioned toward said support structure;

handle means associated with said support structure positioned for grasping by a user for moving said support structure with said tread base in said second position between a use position in which said support structure has said feet means positioned on said support surface for stably positioning said support structure on a support surface and a moving position in which said support structure is rotatably displaced from said use position;

roller means adapted to said feet means for engagement with said support surface when said support structure is reoriented to said moving position for movement of said support structure by the user on said support surface;

means for stably retaining said tread base in said second position relative to said upright structure with said tread base in said second position; and wherein said treadmill is configured to have a center of gravity positioned relative to said roller means and said handle means to facilitate rotation of said treadmill about said wheel means upon application of a rotational force by the user to said handle means.

* * * * *

UNITED STATES PATENT AND TRADEMARK OFFICE

CERTIFICATE OF CORRECTION

PATENT NO. : 5,676,624

DATED : October 14, 1997

INVENTOR(S) : Scott R. Watterson, et al

It is certified that error appears in the above-identified patent and that said Letters Patent is hereby corrected as shown below:

In column 1, line 15, change "mils" to --rails--;
In column 2, line 13, after "support structure has" insert --an--;
In column 2, line 24, after "structure" delete "it";
In column 2, line 52, change "on" to --or--;
In column 3, line 57, change "here shown" to --herein ours--;
In column 4, line 10, change "12'" to --12--;
In column 4, line 30, change "part" to --pan--;
In column 4, line 31, change "from" to --front--;
In column 4, line 52, after "upright structure" insert --42--;
In column 6, line 11, change "incross" to --in cross--;
In column 6, line 36, change "therein between" to --thereinbetween--;
In column 7, line 25, change "part" to --pan--;
In column 7, line 51, change "part" to --pan--;
In column 7, line 51, change "part" to --pan--;
In column 8, line 1, change "part" to --pan--;
In column 8, line 6, change "leg" to --foot--;
In column 8, line 63, change "264" to --265--;
In column 9, line 8, change "265" to --264--;
In column 9, line 21, after has insert --a--;
In column 9, line 23, change "leg 166" to --foot 160--;
In column 9, line 26, change "leg" to --foot--;
In column 9, line 28, after "base" insert --12--;
In column 9, line 50, after "(" insert --to--;
In column 9, line 59, both instances, after "base" insesrt --12--;
In column 9, line 61, change "foot" to --leg--;
In column 10, line 14, change "foot" to --leg--;
In column 10, line 16, after "base" insert --12--;
In column 10, line 19, after "base " insert --12--;

UNITED STATES PATENT AND TRADEMARK OFFICE

CERTIFICATE OF CORRECTION

PATENT NO. : 5,676,624

DATED : October 14, 1997

INVENTOR(S) : Scott R. Watterson, et al

It is certified that error appears in the above-identified patent and that said Letters Patent is hereby corrected as shown below:

In column 10, line 22, change "upright" to --support--;
In column 10, line 46, change "cross member" to --support bar--;
In column 11, line 3, after "member" delete "392";
In column 11, line 26, change "mean" to --means--;
In column 11, line 39, after "position" insert --shown--;
In column 12, line 29, after "alignment" delete "446";
In column 12, line 62, change "422'" to --422--;
In column 13, line 3, after "distance" delete "460";
In column 13, line 10, change "458'" to --458--;
In column 13, line 35, after "clamp" delete "460";
In column 13, line 44, after "upright" change "484" to --477--;
In column 13, line 49, after "handle" change "484" to --477--;
In column 13, line 55, after "forth" delete "484";
In column 13, line 58, after "also" insert --be--;
In column 14, line 29, change "spring" to --cylinder--;
In column 14, line 50, after "foot" insert --(not shown)--;
In column 15, line 6, change "spring" to --cylinder--;
In column 15, line 9, change "spring" to --cylinder--;
In column 15, line 13, change "spring" to --cylinder--;

UNITED STATES PATENT AND TRADEMARK OFFICE

CERTIFICATE OF CORRECTION

PATENT NO. : 5,676,624

DATED : October 14, 1997

INVENTOR(S) : Scott R. Watterson, et al

It is certified that error appears in the above-identified patent and that said Letters Patent is hereby corrected as shown below:

In column 15, line 14, change "spring" to --cylinder--;
In column 15, line 16, change "spring" to --cylinder--;
In column 15, line 23, change "spring" to --cylinder--;
In column 16, line 12, change "512" to --515--;
In column 17, line 13, change "556" to --546--;
In column 17, line 16, change "556" to --546--;
In column 18, line 3, before "support" insert --a--;
In column 19, line 18, before "support" insert --a--;

Signed and Sealed this

Thirtieth Day of March, 1999

*Attest:*

*Attesting Officer*

Q. TODD DICKINSON

*Acting Commissioner of Patents and Trademarks*

US005676624C1

(12) EX PARTE REEXAMINATION CERTIFICATE (6230th)

United States Patent

Watterson et al.

(10) Number: US 5,676,624 C1

(45) Certificate Issued: May 20, 2008

(54) PORTABLE REORIENTING TREADMILL

(75) Inventors: Scott R. Watterson, Logan, UT (US); William T. Dalebout, Logan, UT (US); Rodney L. Hammer, Lewiston, UT (US)

(73) Assignee: Back Bay Capital Funding LLC, Boston, MA (US)

Reexamination Request:
No. 90/005,117, Sep. 25, 1998

Reexamination Certificate for:

| | |
|---|---|
| Patent No.: | **5,676,624** |
| Issued: | **Oct. 14, 1997** |
| Appl. No.: | **08/594,271** |
| Filed: | **Jan. 30, 1996** |

Certificate of Correction issued Mar. 30, 1999.

(51) Int. Cl.
*A63B 22/02* (2006.01)

(52) U.S. Cl. ..... 482/54

(58) Field of Classification Search ..... 482/42
See application file for complete search history.

(56) References Cited

U.S. PATENT DOCUMENTS 4,370,766 A * 2/1983 Teague ..... 5/133

OTHER PUBLICATIONS

Damark International, Inc. Mail Order Catalog, dated Nov. 17, 1994, cover page and p. 6.

Treadmill Owner's Manual by Formula 22100 Manual Treadmill (undated, but see "Other Material Information" in the Request).

* cited by examiner

*Primary Examiner*—Jeanne M. Clark

(57) ABSTRACT

The treadmill has a tread base that is rotatably attached to and between a left upright and a right upright. The tread base is rotatable between a first position for performing exercises and an upright or storage position. A latching structure is provided to latch the tread base to the support structure. The treadmill also includes inclination structure for inclining the tread relative to the support surface when in the first position. The treadmill also includes rigid handles and in one configuration movable handles. The tread base also has a rigid undersurface or pan to fully enclose the underside of the tread base. A lift assist gas cylinder is also interconnected between the tread base and the feet attached to the uprights.

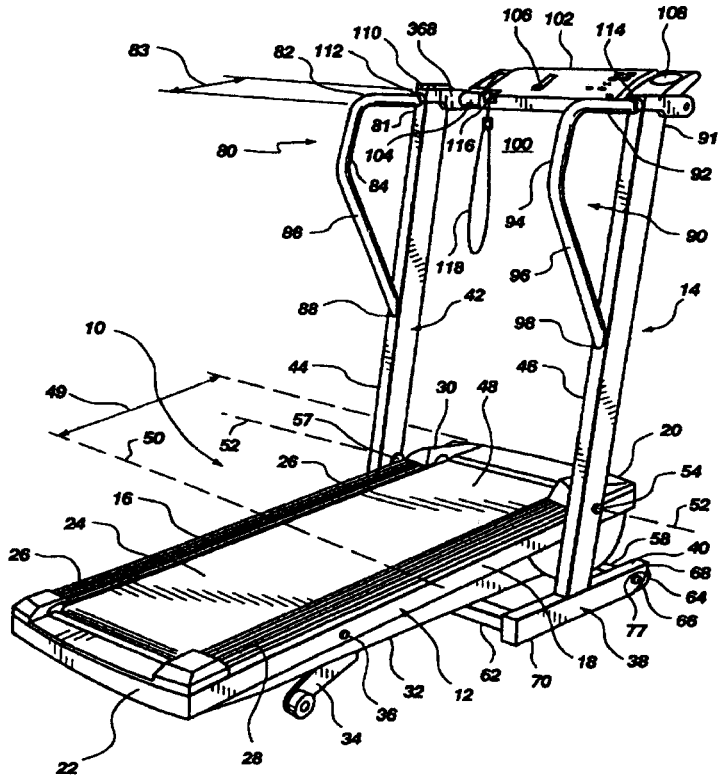

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–12 are cancelled.

Claim 13 is determined to be patentable as amended.

13. A treadmill comprising:

a support structure having [feet means] *a base* for stably positioning on a support surface to be free standing and having upright structure extending upwardly from said [feet means] *base*;

a tread base having a frame that includes a front, a rear, a left side, a right side and an endless belt positioned between said left side and said right side, said frame being connected to said support structure to be movable between a first position in which said endless belt is positioned for operation by a user positioned thereon and a second position in which said rear of said frame is positioned toward said support structure;

handle means associated with said support structure positioned for grasping by a user for moving said support structure with said tread base in said second position between a use position in which said support structure has said [feet means] *base* positioned on said support surface for stably positioning said support structure on a support surface and a moving position in which said support structure is rotatably displaced from said use position;

roller means adapted to said [feet means] *base* for engagement with said support surface when said support structure is reoriented to said moving position for movement of said support structure by the user on said support surface;

means for stably retaining said tread base in said second position relative to said upright structure with said tread base in said second position; and wherein said treadmill is configured to have a center of gravity positioned relative to said roller means and said handle means to facilitate rotation of said treadmill about said wheel means upon application of a rotational force by the user to said handle means.

* * * * *